US006867359B2

(12) United States Patent
Koseki et al.

(10) Patent No.: US 6,867,359 B2
(45) Date of Patent: Mar. 15, 2005

(54) MUSICAL INSTRUMENT CAPABLE OF CHANGING STYLE OF PERFORMANCE THROUGH IDLE KEYS, METHOD EMPLOYED THEREIN AND COMPUTER PROGRAM FOR THE METHOD

(75) Inventors: Shinya Koseki, Hamamatsu (JP); Haruki Uehara, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/778,368

(22) Filed: Feb. 12, 2004

(65) Prior Publication Data

US 2004/0168564 A1 Sep. 2, 2004

(30) Foreign Application Priority Data

Feb. 28, 2003 (JP) ..... 2003-053872

(51) Int. Cl.[7] ..... G10H 1/18; G10H 7/00
(52) U.S. Cl. ..... 84/615; 84/653; 84/718
(58) Field of Search ..... 84/718–720, 615, 84/653

(56) References Cited

U.S. PATENT DOCUMENTS 4,624,170 A 11/1986 Ohno et al.
4,711,148 A * 12/1987 Takeda et al. ..... 84/653
4,862,784 A * 9/1989 Kimpara ..... 84/622
5,105,709 A * 4/1992 Suzuki ..... 84/615
5,496,963 A * 3/1996 Ito ..... 84/653
5,652,402 A * 7/1997 Kondo et al. ..... 84/653
5,949,013 A 9/1999 Satoshi

FOREIGN PATENT DOCUMENTS

| | | |
|---|---|---|
| EP | 0 381 530 | 2/1989 |
| EP | 0 375 370 | 6/1990 |
| EP | 0 847 039 | 6/1998 |
| JP | 200194369 | 7/2000 |
| JP | 2001067074 | 3/2001 |

* cited by examiner

*Primary Examiner*—Jeffrey W Donels
(74) *Attorney, Agent, or Firm*—Morrison & Foerster

(57) ABSTRACT

A silent piano is available for a performance through electronic tones, and a player can give a timbre different from that of an acoustic piano to the electronic tones; when the player specifies a timbre of another acoustic musical instrument having a compass narrower than the compass of the acoustic piano, the key levers outside of the compass are never depressed in the performance, and several musical performance styles such as mute, glissando, tremolo and so fourth are assigned to the idle key levers; while the player is fingering on the keyboard, the player depresses one of the idle key levers and, thereafter, the black and white key levers in the compass, then, the electronic tones are produced in the selected musical performance style; the idle key levers are not mixed in the compass so that the player is less liable to be mistakenly depress the idle key levers.

21 Claims, 10 Drawing Sheets

MUSICAL INSTRUMENT CAPABLE OF CHANGING STYLE OF PERFORMANCE THROUGH IDLE KEYS, METHOD EMPLOYED THEREIN AND COMPUTER PROGRAM FOR THE METHOD

FIELD OF THE INVENTION

This invention relates to a musical instrument and, more particularly, to a musical instrument capable of changing an attribute of electronically produced tones.

DESCRIPTION OF THE RELATED ART

The term "key" has plural meanings. The term "key" is described in DICTIONARY OF MUSIC as (1) a lever, e.g. on piano, organ, or a woodwind instrument, depressed by finger or foot to produce a note; (2) a classification of the notes of a scale. In order to make the "key" with the first meaning discriminative from the "key" with the second meaning, word "lever" is added to the term "key" with the first meaning.

An electronic piano is a sort of the musical instrument. The electronic piano includes a keyboard, i.e., an array of key levers, key switches, a tone generating system and a sound system. The pitch names are respectively assigned to the key levers, and a player instructs the electronic piano to produce tones by depressing the key levers. While a player is fingering a piece of music on the keyboard, the key switches find the depressed keys and released keys, and the tone generating system produces an audio signal from the pieces of waveform data specified by the depressed keys for supplying the audio signal to the sound system. The analog signal is converted to electronic tones so that the audience hears the piece of music through the electronic tones.

Although there are several exceptions, pieces of music usually have the tonality, and the keynotes stand for those pieces of music. If two pieces of music have a certain key, the tones to be produced are specified through predetermined key levers, which belongs to the scale identified with the keynote. On the other hand, if two pieces of music have different keys, the key levers required for one of the pieces of music are different from the key levers to be depressed in the performance on the other piece of music. Thus, all the key levers are not always required for the performance. In other words, the player has foreign key levers on the keyboard depending upon the keynote of the piece of music to be performed. The player keeps the foreign key levers idle in his or her performance.

A prior art electronic keyboard musical instrument is disclosed in Japanese Patent No. 2530892. The prior art electronic keyboard musical instrument includes the keyboard, tone generating system and sound system, and the foreign key levers are able to be diverted from the designation of the tones to be produced to preliminary registration of several styles of music performance in which the electronic tones are to be produced. In detail, when a pianist prepares the prior art keyboard musical instrument for a piece of music to be performed in C major, he or she finds the key levers $A\#_6$-$A\#_2$ to be foreign key levers so that he or she can assign the foreign key levers $A\#_6$-$A\#_2$ to "vibrato", timbre tablets, "portamento" and pitch bend.

The use of the foreign key levers is desirable from the viewpoint of production cost, because the manufacturer can remove the tablet switches exclusively used for those styles of music performance from the prior art keyboard musical instrument. However, a problem is encountered in the prior art keyboard musical instrument in that the foreign key levers are too few to satisfy the users.

Another problem inherent is that the player is liable to mistakenly depress the foreign key levers. This is because of the fact that the foreign key levers are mixed with the key levers to be depressed for designating the pitches of the tones. When the player mistakenly depresses the foreign key lever, the electronic tones are produced in unintentional musical performance style.

SUMMARY OF THE INVENTION

It is therefore an important object of the present invention to provide a musical instrument, many manipulators of which are diverted to selection of musical performance styles without confusion with other manipulators used in designation of pitch names.

To accomplish the object, the present invention proposes to assign idle manipulators outside of the group of manipulators used in performance to designation of style or styles of performance.

In accordance with one aspect of the present invention, there is provided a musical instrument capable of producing tones in different musical performance styles comprising a manipulator array including plural manipulators respectively assigned pitch names and independently used in performance, and an electronic sound generating system connected to the manipulator array, assigning at least one musical performance style different from a default musical performance style to at least one manipulator selected from the manipulator array and located outside of a group of other manipulators continuously arranged in the manipulator array and responding to manipulation on the other manipulators without any manipulation on the aforesaid at least one manipulator for producing tones at the pitch names identical with the pitch names assigned to the other manipulated manipulators in the default musical performance style and further to the manipulation on the other manipulators after the manipulation on the aforesaid at least one manipulator for producing the tones in the aforesaid at least one musical performance style.

In accordance with another aspect of the present invention, there is provided a method for producing tones comprising the steps of a) assigning at least one musical performance style different from a default musical performance style to at least one manipulator located outside of a group of other manipulators continuously arranged in a manipulator array for designating pitch names of tones to be produced in response to a user's instruction, b) periodically checking the manipulator array to see whether or not the user manipulates the aforesaid at least one manipulator and whether or not the user selectively manipulates the other manipulators, c) producing tones at pitch names identical with the pitch names assigned to the manipulated manipulators in the default musical performance style if the user has not manipulated the aforesaid at least one manipulator, d) producing tones at pitch names identical with the pitch names assigned to the manipulated manipulators in the aforesaid at least one musical performance style without execution at the step c) if the user has manipulated the aforesaid at least one manipulator and e) repeating the steps b), c) and d) for producing the tones selectively in the default musical performance style and the aforesaid at least one musical performance style.

In accordance with yet another aspect of the present invention, there is provided a computer program for a method of producing tones comprising the steps of a)

assigning at least one musical performance style different from a default musical performance style to at least one manipulator located outside of a group of other manipulators continuously arranged in a manipulator array for designating pitch names of tones to be produced in response to a user's instruction, b) periodically checking the manipulator array to see whether or not the user manipulates the aforesaid at least one manipulator and whether or not the user selectively manipulates the other manipulators, c) producing tones at pitch names identical with the pitch names assigned to the manipulated manipulators in the default musical performance style if the user has not manipulated the aforesaid at least one manipulator, d) producing tones at pitch names identical with the pitch names assigned to the manipulated manipulators in the aforesaid at least one musical performance style without execution at the step c) if the user has manipulated the aforesaid at least one manipulator and e) repeating the steps b), c) and d) for producing the tones selectively in the default musical performance style and the aforesaid at least one musical performance style.

BRIEF DESCRIPTION OF THE DRAWINGS

The features and advantages of the keyboard musical instrument will be more clearly understood from the following description taken in conjunction with the accompanying drawings, in which.

DESCRIPTION OF THE PREFERRED EMBODIMENTS

System Configuration

Figure 1:
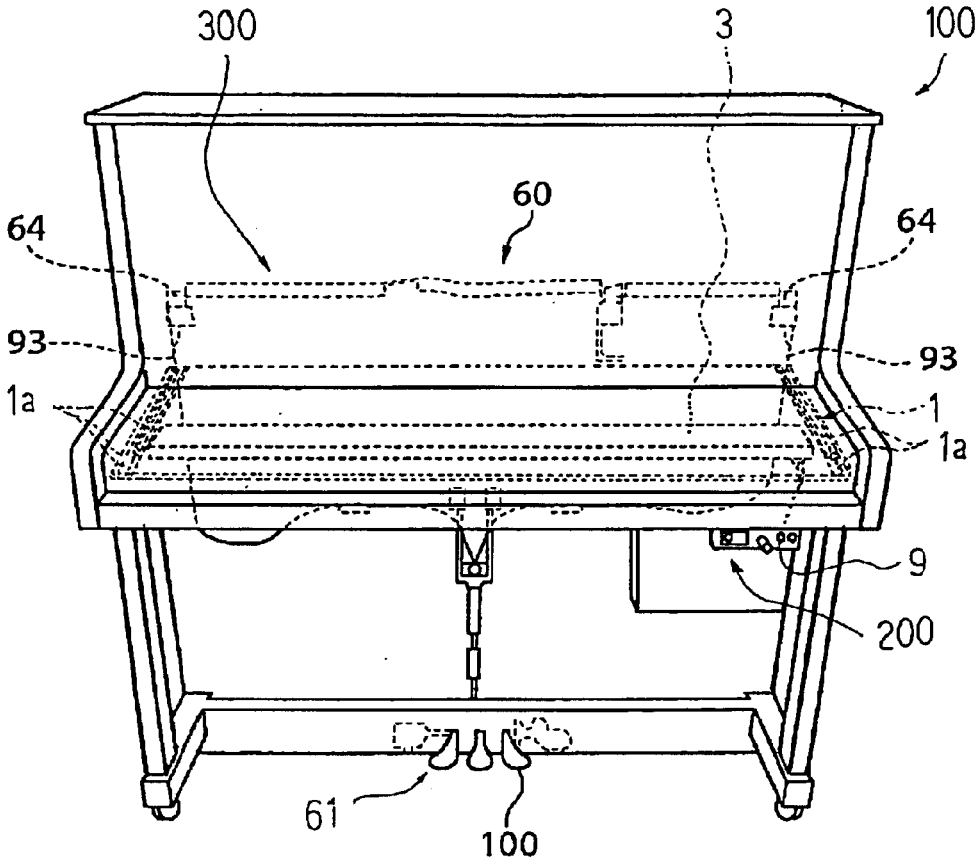
FIG. 1 is a perspective showing the structure of a silent piano embodying the present invention.

Referring first to FIG. 1 of the drawings, a silent piano largely comprises an acoustic piano 100, an electronic sound generating system 200 and a silent system 300. In this instance, the acoustic piano 100 is of the upright type, and a pianist fingers a music passage on the acoustic piano 100. The acoustic piano 100 is responsive to the fingering so as to produce acoustic piano tones along the music passage.

The electronic sound generating system 200 is integral with the acoustic piano 100, and is also responsive to the fingering so as to produce electronic tones and/or electronic sound. The electronic sound generating system 200 can discriminate certain styles of music performance such as, for example, expression and vibrato on the basis of the unique key motion. However, the player can instruct the electronic sound generating system 200 to produce electronic tone or tones in a certain musical performance style as will be hereinlater described in detail.

The silent system 300 is installed in the acoustic piano 100, and prohibits the acoustic piano 100 from producing the acoustic piano tones. Thus, the silent system 300 permits the pianist selectively to perform a music passage through the acoustic piano tones and electronic tones.

In the following description, term "front" is indicative of a position closer to a pianist sitting on a stool for fingering than a position modified with term "rear". The direction between a front position and a corresponding rear position is referred to as "fore-and-aft direction", and term "lateral" is indicative of the direction perpendicular to the fore-and-aft direction.

Acoustic Piano

Figure 2:
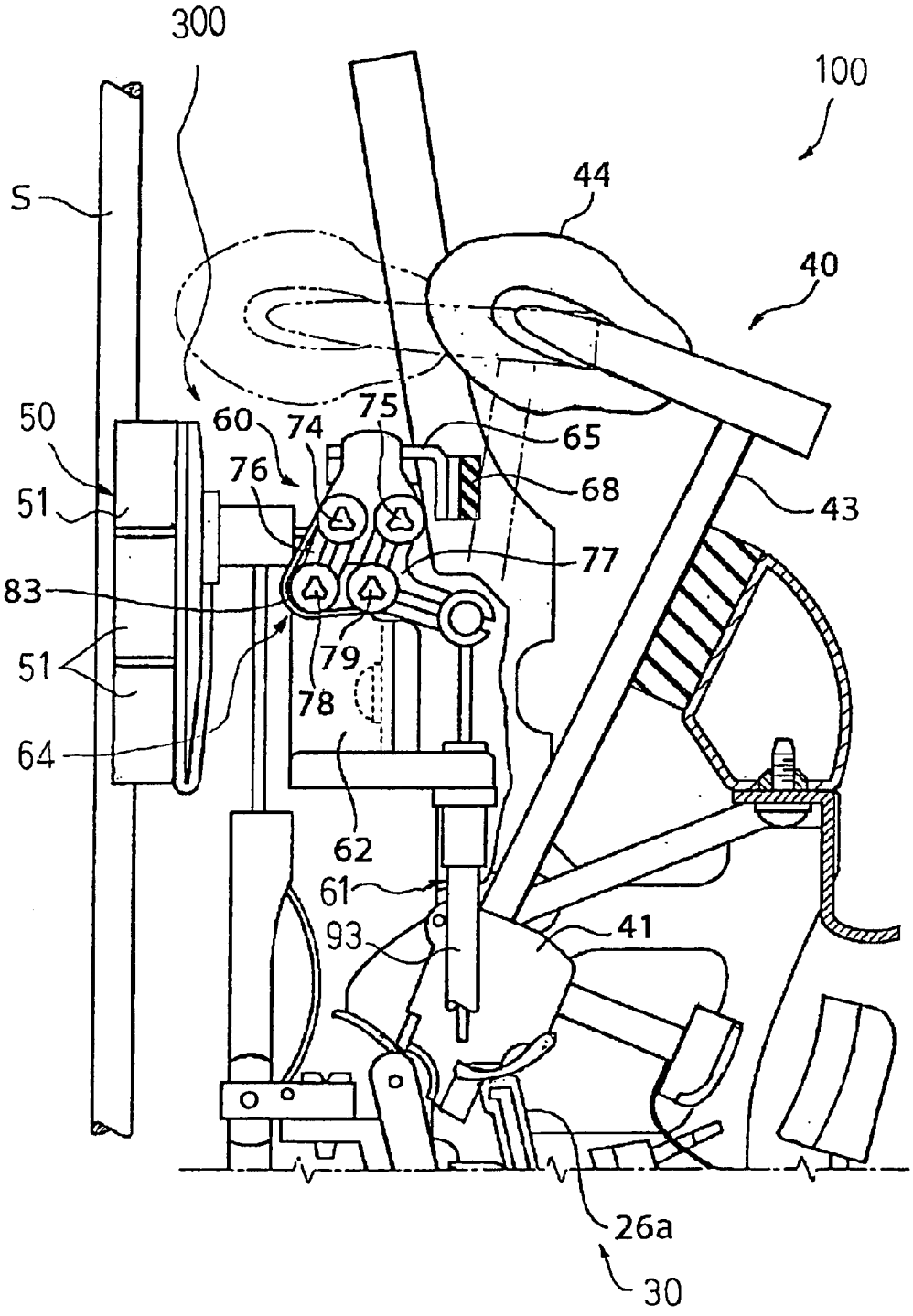
FIG. 2 is a cross sectional side view showing the components of an acoustic piano forming a part of the silent piano.

The acoustic piano 100 is similar in structure to a standard upright piano. A keyboard 1 is an essential component part of the acoustic piano, and action units 30, hammers 40, dampers 50 and strings S are further incorporated in the acoustic piano 100 as shown in FIG. 2. The keyboard 1 includes plural, typically eighty-eight, black and white key levers 1*a*, and the black and white key levers 1*a* are laid on the well-known patter. In this instance, the black and white key levers 1*a* are made of wood, and are turnably supported at intermediate portions thereof by a balance rail (not shown). The front portions of the black and white key levers 1*a* are exposed to the pianist, and are selectively sunk from rest positions toward end positions in the fingering.

While a user is playing a piece of music on the keyboard 1 through the acoustic piano tones, the user selectively depresses and releases the black/white key levers 1*a* for designating the pitches of the acoustic piano tones. However, when the user instructs the silent system 300 to prohibit the acoustic piano 100 from generating the acoustic piano tones, the keyboard 1 is partially used for designating the pitches of the electronic tones and partially used for selecting an musical performance style in which the electronic tones are to be produced. Of course, if the user does not assign any black/white key lever to the musical performance style, all the black and white key levers 1*a* are available for designating the pitches of the electronic tones. In this instance, the black and white key levers 1*a* available for the selection of musical performance styles are referred to as idle key levers 1*a*. The idle key levers 1*a* are provided on either side or both sides of a compass of an acoustic musical instrument, the timbre of which is selected by the user.

The black and white key levers 1*a* are respectively associated with the action units 30, and are respectively linked at the intermediate portions thereof with the associated action units 30. The action units 30 have jacks 26*a*, respectively, and convert the up-and-down motion of the intermediate portions of the associated black and white key levers 1*a* to rotation of their jacks 26*a*.

The black and white key levers 1*a* are further associated with the dampers 50, and are linked at the rear portions thereof with the dampers 50, respectively. When a pianist depresses the front portions of the black and white key levers 1*a*, the rear portions are raised, and give rise to rotation of the associated dampers 50. The dampers 50 have respective damper heads 51, and the damper heads 51 are spaced from the associated strings S through the rotation so as to permit the strings S to vibrate. On the other hand, when the pianist releases the depressed black and white key levers 1*a*, the rear portions are sunk due to the self-weight of the action units 30 exerted on the intermediate portions, and permit the damper heads 51 to be brought into contact with the strings S, again.

The action units 30 are respectively associated with the hammers 40, and are functionally connected to the associated hammers 40 through the jacks 26*a*. The hammers 40 include respective butts 41, respective hammer shanks 43 and respective hammer heads 44. The hammer shanks 43 project from the associated butts 41, and the hammer heads 44 are secured to the leading ends of the hammer shanks 43. When the black and white key levers 1*a* give rise to the rotation, the jacks 26*a* kick the butts 41, and escape from the hammers 40. Then, the hammers 40 are driven for free rotation, and the hammer heads 44 strike the associated strings S at the end of the free rotation in so far as the silent system 300 permits the acoustic piano 100 to produce the acoustic piano tones. If the silent system 300 prohibits the acoustic piano 100 from producing the acoustic piano tones, the hammer shanks 43 rebound before striking the strings S as indicated by dots-and-dash lines in FIG. 2. This means that the strings S do not vibrate, and, accordingly, any acoustic piano tone is never produced.

Electronic Sound Generating System

Figure 3:
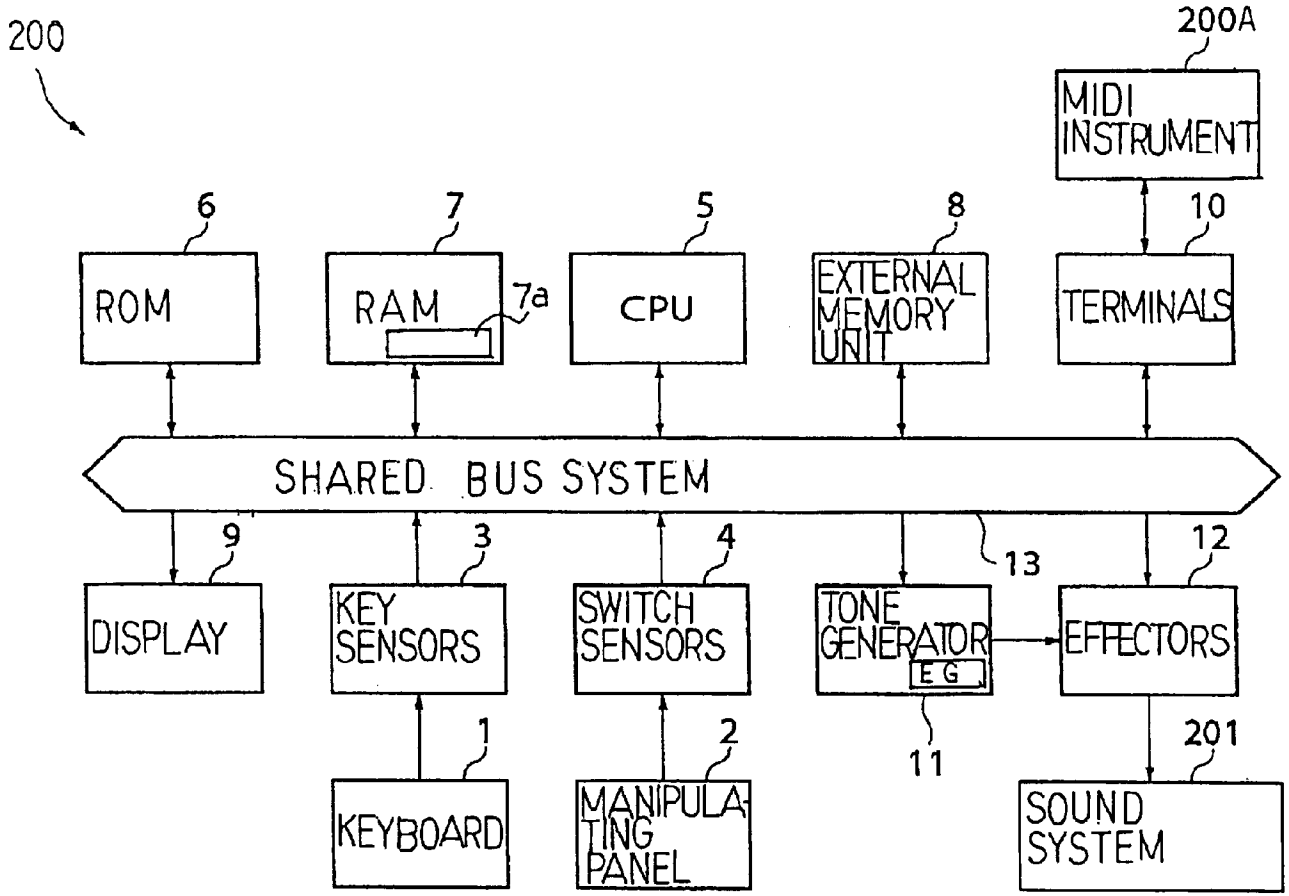
FIG. 3 is a block diagram showing the system configuration of an electronic sound generating system incorporated in the silent piano.

Turning to FIG. 3, the electronic sound generating system 200 includes a manipulating panel 2, an array of key sensors 3, switch sensors 4, a central processing unit 5, which is abbreviated as "CPU", a non-volatile memory 6, which is abbreviated as "ROM", a volatile memory 7, which is abbreviated as "RAM", an external memory unit 8, a display unit 9, terminals 10 such as, for example, MIDI-in/MIDI-out/MIDI-through, a tone generating unit 11, the box of which is simply labeled with words "tone generator", effectors 12, a shared bus system 13 and a sound system 201. The central processing unit 5 may be implemented by a microprocessor. The key sensors 3, switch sensors 4, central processing unit 5, non-volatile memory 6, volatile memory 7, external memory unit 8, display unit 9, terminals 10, tone generating unit 11 and effectors 12 are connected to the shared bus system 13, and are communicable with one another through the shared bus system 13.

A main routine program and subroutine programs are stored in the non-volatile memory 6. Various sorts of data, which are required for the tone generation, are further stored in the non-volatile memory 6. One of the various sorts of data is representative a relation between acoustic musical instruments, the timbres of which are produced through the electronic sound generating system 200, and the compasses thereof on the keyboard 1. The relation between each acoustic musical instrument and the compass is given in the form of a key number table. In the key number tables, flags are defined for all the black and white key levers 1*a*, and the flags are representative of current key state of the associated black and white key levers 1*a*, i.e., depressed state or released state. The flags, which are associated with the black and white key levers 1*a* fallen into the compass, are used for the designation of pitches of the electronic tones to be produced, and selected ones of the flags, which are associated with the black and white key levers 1*a* out of the compass, are indicative of the musical performance style in which the electronic tones are to be produced. When a player selects a timbre, the key number tables are transferred from the non-volatile memory 6 to the volatile memory 7 as will be hereinlater described in detail.

When the electronic sound generating system 200 is powered, the central processing unit 5 starts to run on the main routine program, and sequentially fetches the instruction codes so as to achieve tasks through the execution along the main routine program. While the central processing unit 5 is running on the main routine program, the main routine program conditionally and unconditionally branches to the sub-routine programs, and the central processing unit 5 sequentially fetches the instruction codes of the subroutine programs so as to achieve tasks through the execution.

The volatile memory 7 offers a temporary data storage and a data area for storing waveform data to the central processing unit 5 and tone generating unit 11. A part of the temporary data storage is assigned to a music data code representative of an musical performance style in which the electronic tones are to be produced. A software timer, a software counter CNT and a control flag CNT-F are further defined in the temporary data storage of the volatile memory 7. Thus, the volatile memory 7 is shared between the central processing unit 5 and the tone generating unit 11. The data area assigned to the waveform data is hereinafter referred to as "waveform memory 7*a*". As will be described hereinlater, the volatile memory 7 assists the central processing unit 5 with the tasks. Those tasks are given to the central processing unit 5 for the generation of the electronic tones, and are hereinlater described in detail.

The array of key sensors 3 is provided under the keyboard 1 (see FIG. 1), and monitors the black and white key levers 1*a*. The key sensors 3 produce key position signals representative of current key positions of the associated black and white key levers 1*a*, and supply the key position signals to the central processing unit 5. The central processing unit 5 periodically fetches the pieces of positional data from the data port assigned to the key position signals, and determines the depressed key levers 1*a* and released key levers 1*a* on the basis of series of pieces of positional data accumulated in the volatile memory 7.

Light emitting devices, optical fibers, sensor heads, light detecting devices and key shutter plates may form in combination the array of key sensors 3. The sensor heads are disposed under the keyboard 1, and are alternated with the trajectories of the key shutter plates. The key shutter plates are respectively secured to the lower surfaces of the black and white key levers 1*a* so as to be moved along the individual trajectories together with the associated black and white key levers 1*a*. Each light emitting device generates light, and the light is propagated through the optical fibers to selected ones of the sensor heads. Each sensor head split the light into two light beams, and radiates the light beams across the trajectories of the key shutter plates on both sides thereof. The light beams are incident on the sensor heads on both sides, and are guided to the optical fibers. The light is propagated through the optical fibers to the light detecting devices, and the light detecting devices convert photo current. The photo current and, accordingly, the potential level are proportionally varied with the amount of incident light, and the potential level is, by way of example, converted to 7-bit key position signal by means of suitable analog-to-digital converter. The key position signals are supplied to the data port of the central processing unit 5. The central processing unit 5 periodically fetches the piece of positional data represented by each key position signals, and accumulates the pieces of positional data in a predetermined data storage area in the volatile memory 7. The central processing unit 5 checks the predetermined data storage to see whether or not the black and white keys 1*a* change the present key position on the basis of the accumulated positional data. The central processing unit 5 may further analyze the accumulated positional data to see whether or not the player moves the black/white key lever 1*a* for expression and/or pitch bend.

The keyboard 1 may permit the player to depress the black and white key levers 1*a* over the lower stopper provided on the trajectories. In this instance, the central processing unit 5 can control the depth of vibrato on the basis of the positional data.

The display unit 9 is provided on the manipulating panel 2, and includes a liquid crystal display window and arrays of light emitting diodes. The display unit 9 produces visual images representative of prompt messages, current status, acknowledgement of the user's instructions and so forth under the control of the central processing unit 5.

The switch sensors 4 are provided in the manipulating panel 2, and monitor switches, tablets and control levers on the manipulating panel 2. The switch sensors 4 produce instruction signals representative of user's instructions, and supply the instruction signals to the central processing unit 5. The central processing unit 5 periodically checks a data port assigned to the instruction signals for the user's instructions. When the central processing unit 5 acknowledges the user's instruction, the central processing unit 5 enters a corresponding subroutine program, and requests the display unit 9 to produce appropriate visual images, if necessary.

The external memory unit 8 is, by way of example, implemented by an FDD (Flexible Disc Drive), a HDD (hard Disc Drive) or a CD-ROM (Compact Disc Read Only Memory) drive. The data holding capacity of the external memory unit 8 is so large that a designer or user can store various sorts of data together with application programs. For example, plural sets of pieces of music data and plural sets of pieces of waveform data are stored in the external memory unit 8, and are selectively transferred to the music data storage area of the volatile memory 7 and waveform memory 7*a*.

Each set of pieces of music data is representative of a piece of music, and are prepared for a playback in the form of binary codes such as, for example, MIDI (Musical Instrument Digital Interface) music data codes. Different timbres are respectively assigned to the plural sets of pieces of waveform data. For example, one of the plural sets is assigned the electronic tone to be produced as if performed on an acoustic piano, and another set is assigned the electronic tones to be produced as if performed on a guitar. Still another set is assigned the electronic tones to be produced as if performed on a flute. Yet another set is assigned the electronic tones to be produced as if performed on a violin. Thus, the waveform memory 7*a* makes it possible that the electronic sound generating system 200 produces the electronic tones selectively in different timbres.

Each set of pieces of waveform data includes plural groups of pieces of waveform data. Plural styles of rendition or musical performance are respectively assigned to the plural groups of pieces of waveform data. One of the plural groups of pieces of waveform data is assigned the electronic tones to be produced in the standard musical performance. In case where the electronic tones are to be produced as if performed on a guitar, other styles of musical performance may be a mute, a glissando, a tremolo, a hammering-on and a pulling-off. Thus, the keyboard musical instrument makes it possible to produce the electronic tones in different styles of musical performance.

Each group of waveform data includes plural series of pieces of waveform data. The plural series of pieces of waveform data express the waveform of the electronic tones at different pitches. The pitch names assigned to the electronic tones are identical with the pitch names assigned to the black and white key levers 1*a*. A user is assumed to depress one of the black and white key levers 1*a* in the standard musical performance. The central processing unit 5 specifies the depressed key lever 1*a*, and produces the music data code representative of the note-on event at the pitch name. The music data code is supplied to the tone generating unit 11, and the tone generating unit 11 sequentially reads out the series of pieces of music data, which represents the waveform of the electronic tone to be produced in the standard musical performance style at the pitch name, from the waveform memory 7*a*, and produces an audio signal from the series of pieces of waveform data. Thus, the electronic sound generating system 200 can produce the electronic tones at different pitches in different timbres and different styles of music performance.

The other application programs may be further stored in the external memory unit 8 as described hereinbefore. The other application programs are not indispensable for the electronic sound generating system 200. However, the tasks expressed by the other application programs assist the main and subroutine programs in producing the electronic tones. Thus, the application programs are convenient to the users. The application program is, by way of example, given to the central processing unit 5 in the form of a new version of the main and/or subroutine programs. The other application programs are transferred to the volatile memory 7 at the system initialization after the power-on. In case where the new main and/or subroutine program or programs are transferred to the volatile memory 7 at the system initialization, the central processing unit 5 runs on the new version instead of the previous version already stored in the non-volatile memory 6. Thus, the external memory unit 8 allows the user easily to make the computer program version-up.

A MIDI instrument 200A is connectable to the electronic sound generating system 200 through the terminals 10, and MIDI data codes are transferred between the electronic sound generating system 200 and the MIDI instrument 200A through the terminals 10 under the control of the central processing unit 5.

The tone generating unit 11 has a data processing capability, which is realized through a microprocessor, and accesses the waveform memory 7*a* for producing the audio signal. The tone generating unit 11 produces the audio signal from the series of pieces of waveform data on the basis of music data codes indicative of the electronic tones and timbre to be produced. The music data codes are supplied from the central processing unit 5 to the tone generating unit 11. The music data code representative of a note-on event is assumed to reach the tone generating unit 11. The tone generating unit 11 determines the pitch of the electronic tone to be produced on the basis of the key code, which forms a part of the music data code, and accesses a corresponding series of pieces of waveform data. The pieces of waveform data are sequentially read out from the waveform memory, and are formed into the audio signal.

An envelope generator EG and registers are incorporated in the tone generating unit 11. The envelope generator EG controls the envelope of the audio signal so that the tone generator unit 11 can decay the loudness of the electronic tones through the envelope generator EG. A music data code representative of a piece of finish data makes the envelope generator EG decay the loudness. One of the registers is assigned to a timbre in which the electronic tones are to be produced. In case where the player does not designate any timbre, a timbre code is indicative of a default timbre. The default timbre may be the piano. On the other hand, when the player selects another timbre such as, for example, the violin, flute, guitar or trumpet, the timbre code representative of the selected timbre is stored in the register. While the player is fingering a piece of music on the black and white key levers 1*a* in the compass, the tone generating unit 11 checks the register for the address assigned the file TCDk corresponding to the selected timbre, and selectively reads of the series of pieces of waveform data from the appropriate records in the file TCDk.

The tone generating unit 11 can produce the electronic tones as if acoustic tones are performed on an acoustic musical instrument in a certain musical performance style. While the player is fingering a piece of music on the keyboard 1, the player may depress one of the idle key levers assigned to the certain musical performance style. In this situation, the tone generating unit 11 accesses the waveform memory 7*a*, and reads out certain pieces of waveform data representative of the waveform of the electronic tone or tones to be produced in the certain musical performance style. The audio signal is produced from the certain pieces of waveform data so that the electronic tone or tones are produced in the certain musical performance style.

The central processing unit 5 can request the tone generating unit 11 to produce the electronic tone or tones in the certain musical performance style on the basis of the analysis on the accumulated positional data without any player's instruction. The central processing unit 5 may behave for the expression as follows. A black/white key lever 1*a* is assumed to be depressed. When the black/white key lever 1*a* reaches a certain point on the trajectory after a short stroke, the central processing unit 5 produces the music data codes representative of the pitch name, a certain velocity and an expression value "0" to the tone generating unit 11. While the black/white key lever 1*a* is sinking toward the lower stopper, the central processing unit 5 increases the expression value toward "127", and successively supplies the music data code representative of the increased expression value to the tone generating unit 11. The tone generating unit 11 is responsive to the expression value so as to increase the loudness of the electronic tone from the silence to the maximum. If the player depresses the black/white key lever 1*a* under the lower stopper, the central processing unit 5 acknowledges the after-touch, and requests the tone generating unit 11 to produce the electronic tone in vibrato depending upon the depth under the lower stopper. Thus, the electronic tone or tones are produced in the certain musical performance style with or without the player's instruction through the idle key lever 1*a*.

The effectors 12 are provided on the signal propagation path from the tone generating unit 11 to the sound system 201, and is responsive to the music data codes, which are supplied from the central processing unit 5, for giving an effect to the electronic tone.

The sound system 201 includes amplifiers and a headphone. Loud speakers may be further incorporated in the sound system 201. The audio signal is supplied to the sound system, and is converted to the electronic tones through the headphone and/or loud speakers.

Silent System

Turning back to FIGS. 1 and 2, the silent system 300 includes a hammer stopper 60 and a change-over mechanism 61. The hammer stopper 60 laterally extends in the space between the hammers 40 and the strings S, and the user can move the hammer stopper 60 into and out of the trajectories of the hammer shanks 43 by means of the change-over mechanism 61. While the hammer stopper 60 is resting at a free position, which is out of the trajectories of the hammer shanks 43, the hammer heads 44 can reach the strings S, and strike the strings S so that the strings S vibrate for producing the acoustic piano tones. When the user changes the hammer stopper 60 to a blocking position, the hammer stopper 60 enters the trajectories of the hammer shanks 43, and the hammer shanks 43 rebound on the hammer stopper 60 before striking the strings S. This means that the hammer heads 44 can not give rise to the vibrations of the strings S. Thus, the silent system 300 permits the acoustic piano 100 to produce the acoustic piano tones and prohibits it from them depending upon the position thereof.

The hammer stopper 60 is supported by brackets 64 through coupling units 64. The coupling units 64 are driven for rotation by means of the change-over mechanism 61. The hammer stopper 60 includes a stopper rail 65 and cushions 68. The stopper rail 65 extends in the lateral direction, and is secured at both ends thereof to the coupling units 64. The cushions 68 are secured to the front surface of the stopper rail 65, and are confronted with the hammer shanks 43.

The coupling units 64 are similar in structure to each other, and each of the coupling units 64 includes a pair of levers 76/77 and four pins 74, 75, 78 and 79. The levers 76 and 77 are arranged in parallel to each other, and are coupled at the upper ends thereof to the stopper rail 65 by means of the pins 74 and 75 and at the lower ends thereof to the brackets 62 by means of the pins 78 and 79. The pins 78 and 79 permit the levers 76 and 77 to rotate about the brackets 62, and the other pins 74 and 75 permit the levers 76 and 77 to change the attitude through the relative rotation to the stopper rail 65. The levers 76/77 and pins 74/75/78/79 form in combination a parallel crank mechanism. When the pins 74/75/78/79 make the levers 76 and 77 inclined, the stopper rail 65 and, accordingly, cushions 68 are forwardly moved, and the cushions 68 enter the trajectories of the hammer shanks 43. On the other hand, when the levers 76 and 77 rise, the stopper rail 65 and cushions 68 backward moved, and the cushions 68 are retracted from the trajectories of the hammer shanks 43.

The change-over mechanism 61 includes a foot pedal 100, flexible wires 93 and return springs 83. Though not shown in the drawings, a suitable lock mechanism is provided in association with the foot pedal 100, and keeps the foot pedal 100 depressed. The foot pedal 100 frontward projects from a bottom sill, which forms a part of the piano case, and is swingably supported by a suitable bracket inside the piano case. The foot pedal 100 is connected through a link work to the lower ends of the flexible wires 93, and the flexible wires 93 are connected at the upper ends thereof to the parallel crank mechanism. The return springs 83 are provided between the brackets 62 and the parallel crank mechanism, and always urge the levers 76 and 77 in the counter clockwise direction, which is determined in FIG. 2. Thus, the hammer stopper 60 is urged to enter the free position.

Assuming now that the user steps on the foot pedal 100, the flexible wires 93 are downwardly pulled, and the levers 76 and 77 are inclined against the elastic force of the return springs 83. Then, the cushions 68 frontward project, and enter the trajectories of the hammer shanks 43. The user is assumed to start his or her fingering on the keyboard 1. The depressed key levers 1*a* make the jacks 26*a* of the associated action units 30 escape from the butts 41. Then, the hammers 40 are driven for the free rotation toward the strings S. However, the hammer shanks 43 are brought into contact with the cushions 68 as indicated by the dots-and-dash lines, and rebound thereon. For this reason, the hammer heads 44 do not strike the strings S, and any acoustic piano tone is not produced through the strings S. Instead, the central processing unit 5 determines the depressed key lever 1*a* on the basis of the pieces of positional data obtained through the key position signals, and requests the tone generating unit 11 to produce the audio signal from the pieces of waveform data. The audio signal is supplied to the sound system 201, and the electronic tones are produced through the headphone. When the user releases the depressed key levers 1*a*, the central processing unit 5 specifies the released key levers 1*a*, and requests the tone generating unit 11 to decay the electronic tones. Thus, the user can play pieces of music through the electronic tones at the blocking position.

If the user releases the foot pedal 100 from the depressed state, the return springs 83 cause the levers 76 and 77 to rise. Then, the cushions 68 are moved out of the trajectories of the hammer shanks 43, and the hammer stopper 60 enters the free position. While the user is playing a piece of music on the keyboard 1, the hammers 40 are driven for the free rotation through the escape, and the hammer heads 44 strike the strings S, and give rise to the vibrations of the strings S. The hammer shanks 43 are still spaced from the cushions 68 at the strikes. The vibrating strings S produce the acoustic piano tones. Thus, the silent system permits the user to play pieces of music through the acoustic piano tones.

The silent system 300 is similar to that disclosed in Japanese Patent Application laid-open No. hei 10-149154. Various models of the silent system have been proposed. Several models are proper to a grand piano, and others are desirable for the upright piano. The silent system 300 is replaceable with any model.

File Structure for Waveform Data

Figure 4:
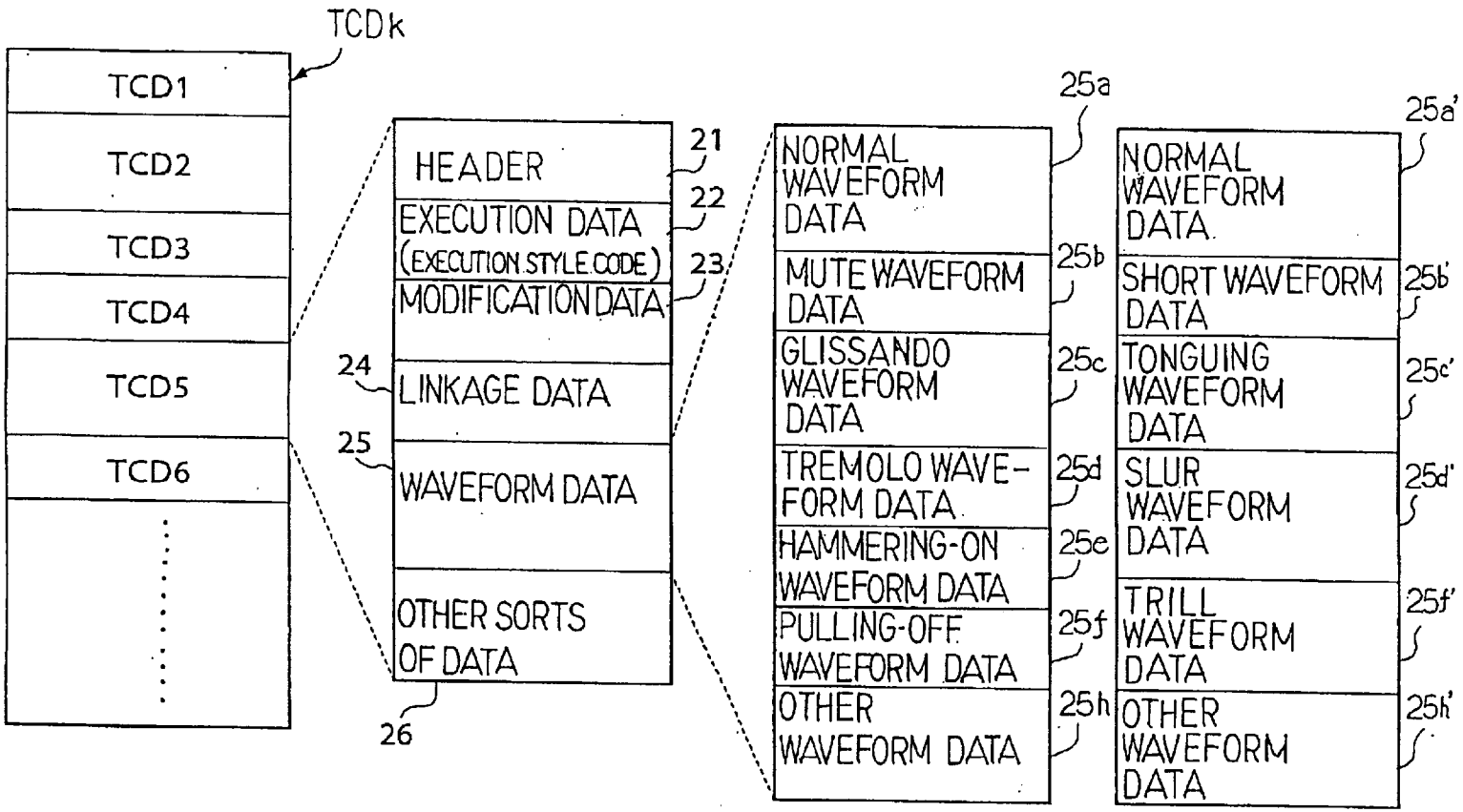
FIG. 4 is a view showing the data structure for waveform data.

As described hereinbefore, the plural groups of pieces of waveform data are stored in the external memory unit 8, and are selectively transferred to the waveform memory 7*a*. FIG. 4 shows a data organization created in a data area of the external memory unit 8 for the plural sets of pieces of waveform data. Plural files TCD1, TCD2, TCD3, TCD4, TCD5, TCD6, . . . are created in the data area, and are respectively assigned to the plural sets of pieces of waveform data. In the following description, reference "TCDk" stands for any one of the plural files or any one of the plural sets of waveform data.

Each of the files TCDk includes plural blocks 21, 22, 23, 24, 25 and 26. The first block 21 is assigned to administrative data, which is referred to as "header". A piece of administrative data is representative of a timbre such as, for example, a guitar, a flute or a violin, and another piece of administrative data represents the storage capacity required for the header.

The second block 22 is assigned to pieces of performance style data. Plural pieces of performance style data are representative of the styles of musical performance in which the electronic sound generating system 200 produces the electronic tones, and are stored in the form of performance style code. Other pieces of execution data are representative of discriminative features of the musical performance styles. The central processing unit 5 can analyzes pieces of music data representative of a piece of music prior to a playback or in a real time fashion. When the central processing unit 5 finds the discriminative feature of a certain musical performance style in plural music data codes representative of a music passage, the central processing unit 5 automatically adds the performance style code representative of the certain musical performance style to the music data codes.

The third block 23 is assigned to pieces of modification data, which are representative of the amount of modifier to be applied to parameters represented by the pieces of music data in the presence of the performance style code.

The fourth block 24 is assigned to pieces of linkage data. The pieces of linkage data are representative of the relation between the pieces of performance style data and the groups of pieces of waveform data. When the performance style code representative of a certain musical performance style reaches the tone generating unit 11, the tone generating unit 11 accesses the fourth block 24, and determines the address assigned to the series of pieces of waveform data to be read out for producing the electronic tone in the certain musical performance style.

The fifth block 25 is assigned to the set of pieces of waveform data. As described hereinbefore, the set of pieces of waveform data is representative of the waveform of electronic tones to be performed in different musical performance styles in given timbre, and the plural groups of pieces of waveform data are incorporated in the set of pieces of waveform data. The file structure of each block will be hereinlater described in detail.

The sixth block 26 is assigned to other sorts of data to be required for the tone generating unit 11. However, the other sorts of data are less important for the present invention, and no further description is hereinafter incorporated for the sake of simplicity.

The fifth block 25 includes plural records 25*a*, 25*b*, 25*c*, 25*d*, 25*e*, 25*f*, 25*h*, . . . , and the plural records 25*a*, 25*b*, 25*c*, 25*d*, 25*e*, 25*f*, 25*h*, . . . are respectively assigned to the different musical performance styles, and the plural series of pieces of waveform data are stored in each of the plural records 25*a*–25*h* for the electronic tones at the pitches identical with the pitch names respectively assigned the black and white key levers 1*a*.

The group of pieces of waveform data, which is assigned the first record 25*a*, is representative of the waveform of the electronic tones to be performed in the standard musical performance style. In case of the guitar, the strings are simply plucked with fingers or a pick in the standard musical performance style. The waveform of the electronic tones to be performed in the standard musical performance style is hereinafter referred to as "normal waveform", and the plural series of pieces of waveform data representative of the normal waveform of electronic tones are referred to as "plural series of normal waveform data".

The other groups of waveform data are assigned to the other records 25*b*–25*h*. In case where the electronic tones are to be produced as if performed on the guitar, the second to sixth records are respectively assigned to the mute, glissando, tremolo, hammering-on, pulling-off, and the other records are assigned to the other musical performance styles. The waveforms of the electronic tones in the mute, glissando, tremolo, hammering-on and pulling-off are referred to as "mute waveform", "glissando waveform", "tremolo waveform", "hammering-on waveform" and "pulling-off waveform", and the plural series of pieces of waveform data representative of these waveforms are referred to as "plural series of mute waveform data", "plural series of glissando waveform data", "plural series of tremolo waveform data", "plural series of hammering-on waveform data" and "plural series of pulling-off waveform data", respectively.

If the block 25 is assigned the group of pieces of waveform data to be produced as if performed on a flute, the plural series of pieces of normal waveform data are stored in the record 25*a*'. In case of the flute, a player continuously blows the flute in the standard musical performance style. The player blows the flute for a short time period. The musical performance style is called as "short", and the second record 25*b*' is assigned the electronic tones to be produced in the "short". The other records 25*c*', 25*d*', 25*e*',

25*f*' and 25*h*' are respectively assigned the electronic tones to be produced in tonguing, slur, trill and other musical performance styles. The waveforms of the electronic tones in the short, tonguing, slur, trill and other musical performance styles are referred to as "short waveform", "tonguing waveform", "slur waveform", "trill waveform" and "other waveforms", and the plural series of pieces of waveform data representative of these waveforms are referred to as "plural series of short waveform data", "plural series of tonguing waveform data", "plural series of slur waveform data", "plural series of trill waveform data" and "plural series of other waveform data", respectively.

The files TCD1, TCD2, TCD3, TCD4, TCD5, TCD6, . . . are selectively transferred to the waveform memory 7*a*. When a player selects a certain timbre on the manipulating panel 2, the switch sensors 4 reports the switch manipulated by the player to the central processing unit 5, and the central processing unit 5 determines the certain timbre. Then, the central processing unit 5 reads out the contents from the corresponding file TCDk, and transfers them to the waveform memory 7*a*.

Preparation for Files

Figure 5:
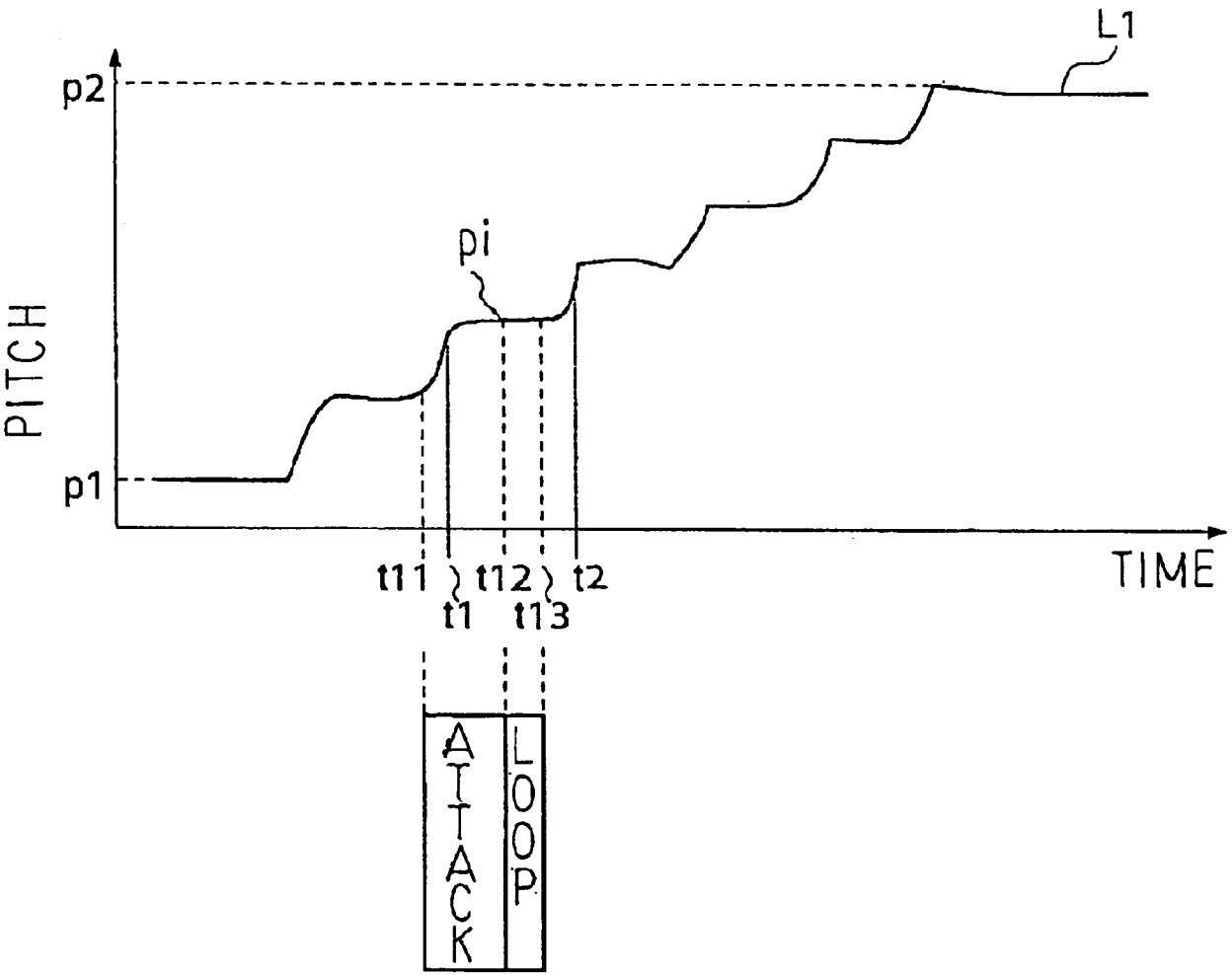
FIG. 5 is a graph showing the pitch varied with time in glissando.

Description is hereinafter made on how the waveform data are prepared for the files TCDk. FIG. 5 shows the pitch of tones produced from a guitar in glissando. The pitch is varied from p1 to p2 with time along plots L1. The guitar sound is converted to an analog signal, and the analog signal is sampled for converting the amplitude to discrete values. The discrete values from t11 to t13 are taken out from the sampled data, i.e., the discrete values from p1 to p2, and are formed into the glissando waveform data at the certain pitch pi, i.e., the series of pieces of glissando waveform data at the pitch pi. The discrete values from t11 to t12 form an attack, and the discrete values from t12 to t13 form a loop. The other series of pieces of glissando waveform data are prepared for the other pitch names in the similar manner to that for the pitch name pi, and are stored in the record 25*c*.

The discrete values from t1 to t2 may exactly represent the electronic tone produced at pitch pi in glissando. However, the series of pieces of glissando waveform data is produced from the discrete values between t11 and t13 at the pitch pi. The electronic tone at the present pitch is to be smoothly changed to the electronic tone at the next pitch. From this point of view, it is necessary to make the series of pieces of glissando waveform data at the present pitch partially overlapped with the series of pieces of glissando waveform data at the next pitch. Thus, the plural series of pieces of glissando waveform data are desirable for the electronic tones continuously increased in pitch, i.e. the glissando.

Figure 6:
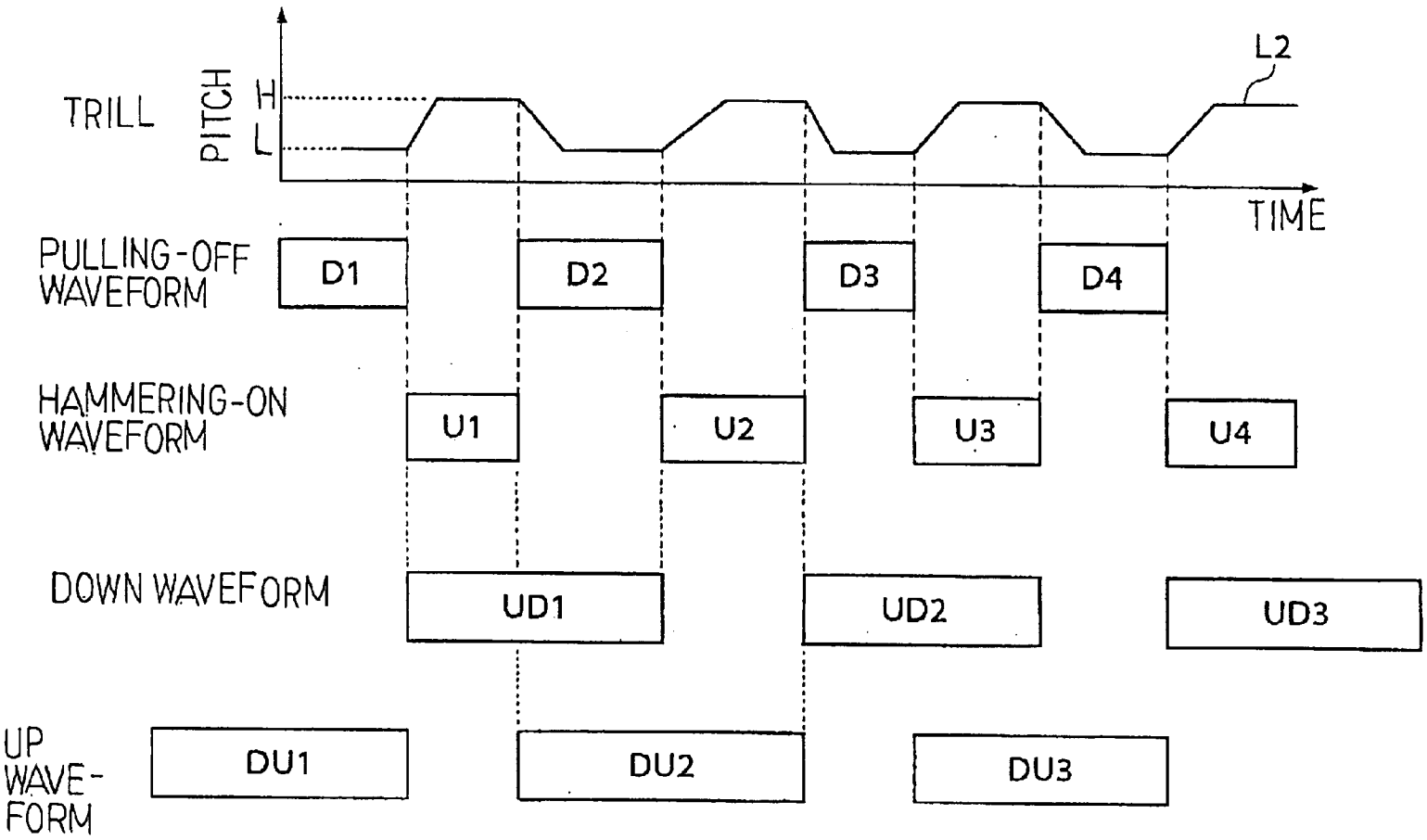
FIG. 6 is a graph showing the pitch varied with time in trill and sampling ranges for several musical performance styles.

Turning to FIG. 6, plots L2 are representative of an audio signal representative of acoustic tones performed on a guitar in trill. The acoustic tones repeatedly change the pitch between high "H" and low "L" with time, and, accordingly, the audio signal similarly changes the amplitude between the corresponding high level and the corresponding low level. The audio signal is available for the pieces of pulling-off waveform data, pieces of hammering-on waveform data, pieces of down waveform data and pieces of up waveform data. The down waveform is equivalent to the hammering-on waveform followed by the pulling-off waveform, and the up waveform is equivalent to the pulling-off waveform followed by the hammering-on waveform.

The audio signal is sampled, and the amplitude is converted to discrete values. The discrete values in ranges D1, D2, D3 and D4 are representative of the tone in the pulling-off so that the discrete values are cut out of the ranges D1 to D4. Plural series of pieces of pulling-off waveform data are produced from the discrete values in the ranges D1, D2, D3 and D4 for an electronic tone at the pitch L. Each series of pieces of pulling-off waveform data includes not only the pieces of waveform data at the pitch L but also the pieces of waveform data in the transition from the high pitch H to the low pitch L. Thus, the series of pieces of pulling-off waveform data make the electronic tones smoothly varied from the high pitch H to the low pitch L.

The discrete values in ranges U1, U2, U3 and U4 are representative of the tone in the hammering-on so that the discrete values are cut out of these ranges. Plural series of pieces of hammering-on waveform data are prepared from the discrete values in the ranges U1, U2, U3 and U4 for an electronic tone at pitch H. Each series of pieces of hammering-on waveform data includes not only the pieces of waveform data at the pitch H but also the pieces of waveform data in the transition from the low pitch L to the high pitch H. Thus, the series of pieces of hammering-on waveform data make the electronic tones smoothly varied from the low pitch L to the high pitch L.

When a player changes the electronic tones from the low pitch L through the high pitch H to the low pitch L, the pieces of sampled data in ranges UD1, UD2 and UD3 stand for the down waveform of the electronic tones. The discrete values are cut out of the ranges UD1, UD2 and UD3, and plural series of pieces of down waveform data are prepared from the sampled data in the ranges UD1, UD2 and UD3.

On the other hand, when the player changes the electronic tones from the high pitch H through the low pitch L to the high pitch H, the pieces of sampled data in ranges Du1, DU2 and DU3 stand for the up waveform of the electronic tones. The discrete values are cut out of the ranges DU1, DU2 and DU3, and plural series of pieces of up waveform data are prepared from the sampled data in the ranges DU1, DU2 and DU3.

The plural series of pieces of pulling-off waveform data, plural series of pieces of hammering-on waveform data, plural series of pieces of down wave-from data and plural series of pieces of up waveform data are thus prepared for each electronic tone, and are stored in the records 25*e*, 25*f* and 25*h*. The reason why the plural series of pieces of waveform data are prepared for the single tone is that the plural series of pieces of waveform data make the electronic tone close to the corresponding acoustic tone produced in the given musical performance style. Even when a player exactly repeats the acoustic tone in the given musical performance style, the timbre and duration are not constant, i.e. they are delicately varied. If only one series of pieces of waveform data is repeatedly read out for the electronic tone in the given musical performance style, the electronic tones are always identical in the timbre and duration with one another, and the user feels the electronic tones unnatural.

The music data code representative of the trill is assumed to reach the tone generating unit 11. The tone generating unit 11 randomly selects the plural series of pieces of pulling-off waveform data from the record 25*f* and the plural series of pieces of hammering-on waveform data from the record 25*e*, and sequentially reads out the selected ones of the plural series of pieces of pulling-off waveform data so as repeatedly to produce the electronic tones from the different series of pieces of pulling-off waveform data and different series of pieces of hammering-on waveform data. As a result, the electronic tones are delicately different in timbre and duration from one another, and the user feels the electronic tones produced in trill natural.

The tone generating unit 11 can produce the electronic tones in trill from the down waveform data or the up waveform data as will be hereinlater described.

Behavior of Tone Generating Unit on Some Musical Performance Style Glissando

Turning back to FIG. 5, the electronic tones are produced from a series of normal waveform data and plural series of pieces of glissando waveform data as if performed on the guitar in glissando as follows. A player is assumed to instruct the sound generating system 200 to produce the electronic tones between a certain pitch and another certain pitch in glissando. The certain pitch and another certain pitch are hereinafter referred to as "start pitch" and "end pitch", respectively.

When the music data code representative of the tone generation at the start pitch reaches the tone generating unit 11, the tone generating unit 11 firstly accesses the record 25*a* assigned to the group of pieces of normal waveform data, and reads out the pieces of normal waveform data representative of the attack of the electronic tone at the start pitch. The audio signal is produced from the pieces of normal waveform data read out from the record 25*a*, and the sound system 201 starts to produce the electronic tone at the start pitch. The tone generating unit 11 further reads out the pieces of normal waveform data representative of the loop of the electronic tone at the start pitch, and continues the data read-out from the record 25*a* until a predetermined time period a is expired after the reception of the music data code representative of the tone generation at the next pitch. When the music data code representative of the tone generation at the next pitch reaches the tone generating unit 11, the tone generating unit 11 requests the envelop generator EG to decay the electronic tone at the start pitch, and starts to access the record 25*c*.

The envelope generator EG starts to decay the envelope of the audio signal. As described hereinbefore, the piece of finish data represents how the envelope generator EG decreases the loudness. The electronic tone at the start pitch is decayed through the predetermined time period á, and reaches the loudness of zero. This means that the electronic tone at the start pitch is still produced in the predetermined time period á concurrently with the electronic tone at the next pitch.

On the other hand, the pieces of glissando waveform data representative of the electronic tone at the next pitch are sequentially read out from the record 25*c* through the predetermined time period á, and the audio signal is produced from the read-out glissando waveform data. Upon completion of the data read-out on the pieces of glissando waveform data representative of the attack of the electronic tone, the tone generating unit 11 starts to read out the pieces of glissando waveform data representative of the loop of the electronic tone at the next pitch, and continues the data read-out for producing the electronic tone at the next pitch or the second pitch. Thus, the electronic tone is increased from the start pitch to the second pitch.

Subsequently, the music data code representative of the tone generation at the third pitch reaches the tone generating unit 11. The tone generating unit 11 requests the envelop generator EG to decay the electronic tone at the second pitch, and starts to read out the pieces of glissando waveform data representative of the attack of the electronic tone at the third pitch. The envelop generator EG decays the envelop of the audio signal through the predetermined time period á so that the electronic tone at the second pitch is extinguished at the end of the predetermined time period á.

On the other hand, the pieces of glissando waveform data representative of the attack of the electronic tone at the third pitch are sequentially read out from the record 25*c* through the predetermined time period á, and the electronic tone at the third pitch is mixed with the electronic tone at the second pitch in the predetermined time period á. Upon completion of the data readout for the pieces of glissando waveform data representative of the attack of the electronic tone at the third pitch, the tone generating unit 11 starts to read out the pieces of glissando waveform data representative of the loop of the electronic tone at the third pitch, and continues the data read-out until the predetermined time period á is expired after the reception of the next music code representative of the tone generation at the fourth pitch.

The tone generating unit 11 repeats the access to the record 25*c* for generating the electronic tones at the different pitches. Finally, the music data code representative of the tone generation at the end pitch reaches the tone generating unit 11. The electronic tone at the previous pitch is decayed through the predetermined time period á, and the electronic tone at the end pitch p2 is produced through the data read-out of the pieces of glissando waveform data. Thus, the sound generating system 200 smoothly produces the electronic tones between the start pitch p1 and the end pitch p2.

Trill

The tone generating unit 11 produces the electronic tones in trill from the plural series of pieces of pulling-off waveform data and plural sereis of hammering-on data as follows.

The music data code is assumed to represent an electronic tone to be produced in trill. The tone generating unit 11 randomly selects one of the plural series of pieces of hammering-on waveform data, and sequentially reads out the pieces of hammering-on waveform data from the selected series. The audio signal is partially produced from the selected series of pieces of hammering-on waveform data.

Subsequently, the tone generating unit 11 randomly selects one of the plural series of pieces of pulling-off waveform data, and sequentially reads out the pieces of pulling-off waveform data from the selected series. The readout pieces of pulling-off waveform data are used for the next part of the audio signal.

Subsequently, the tone generating unit 11 selects another series of pieces of hammering-on waveform data from the record 25*e*, and sequentially reads out the pieces of hammering-on waveform data from the selected series for producing the next part of the audio signal. The tone generating unit 11 randomly selects another series of pieces of pulling-off waveform data, and sequentially reads out the pieces of pulling-off waveform data from the selected series. The read-out pieces of pulling-off waveform data are used for the next part of the audio signal. Thus, the tone generating unit 11 repeats the random selection and sequential data read-out from the records 25*e* and 25*f* so that the electronic tones are produced in trill. The pulling-off waveform data may be firstly read out from the record 25*f* and followed by the hammering-on waveform data.

The tone generating unit 11 can produce the electronic tones in trill from the pieces of down waveform data and the pieces of hammering-on waveform data. Two sorts of pieces of waveform data, i.e., the pieces of down waveform data and the pieces of up waveform data have been already described. The plural series of pieces of down waveform data are cut out of the sampled waveform data L2, and are representative of the end of the low level L through the potential rise, high level H, potential decay and low level L to the end of the low level L. In other words, the plural series of pieces of hammering-on waveform data are respectively followed by the plural series of pieces of pulling-off waveform data. On the other hand, the plural series of pieces of up waveform data are cut out of the sampled waveform data L2, and are representative of the end of the high level H through the potential decay, low level L, potential rise and high level H to the end of the high level H. In other words, the plural series of pieces of pulling-off waveform data are respectively followed by the plural series of pieces of hammering-on waveform data.

When the electronic tones are to be produced in trill, the tone generating unit 11 randomly accesses the record 25*h* assigned to the plural series of pieces of down waveform data or plural series of pieces of up waveform data, and produces the audio signal from the plural series of pieces of down waveform data or plural series of pieces of up waveform data. First, the tone generating unit 11 selects one of the plural series of pieces of down waveform data from the record 25*h*, and sequentially reads out the pieces of down waveform data from the selected series for producing a part of the audio signal. Subsequently, the tone generating unit 11 selects another of the plural series of pieces of down waveform data from the record 25*h*, and sequentially reads out the pieces of down waveform data from the selected series for producing the next part of the audio signal. Thus, the tone generating unit 11 repeats the random selection from the record 25*h* so that the audio signal is produced from the plural series of pieces of down waveform data. The audio signal is converted to the electronic tones in trill.

The tone generating unit 11 can produce the electronic tones in trill from the plural series of pieces of up waveform data in the similar manner to the electronic tones produced from the plural series of pieces of down waveform data. However, the description is omitted for the sake of simplicity.

Only the tone generation in glissando and trill has been described herein-before. The tone generating unit 11 can produce the electronic tones in other musical performance styles. The functions disclosed in Japanese Patent Application laid-open hei 10-214083 or Japanese Patent Application laid-open 2000-122666 may be employed in the tone generation in the musical performance styles.

Utilization of Idling Key Levers

The musical performance styles are designated by the player through idle key levers 1*a* of the keyboard 1. In this instance, the idle key levers 1*a* are dependent on the timbre to be given to the electronic tones. This is because of the fact that acoustic musical instruments are different in compass from one another. In detail, the keyboard 1 includes the black key levers 1*a* and white key levers 1*a*, which are more than the pitch names incorporated in the individual compasses of the acoustic musical instruments. This means that the keyboard 1 has the idle key levers 1*a*, which are out of the compasses of the acoustic musical instruments. While a player is fingering a piece of music on the keyboard 1 through the electronic tones in a given timbre, the compass to be required for the certain timbre is usually narrower than the compass of the keyboard 1, and the player depresses the black and white key levers 1*a* in the compass for the certain timbre, and the other key levers 1*a* stand idle. Those idle key levers 1*a* are available for the designation of the musical performance style.

Figure 7:
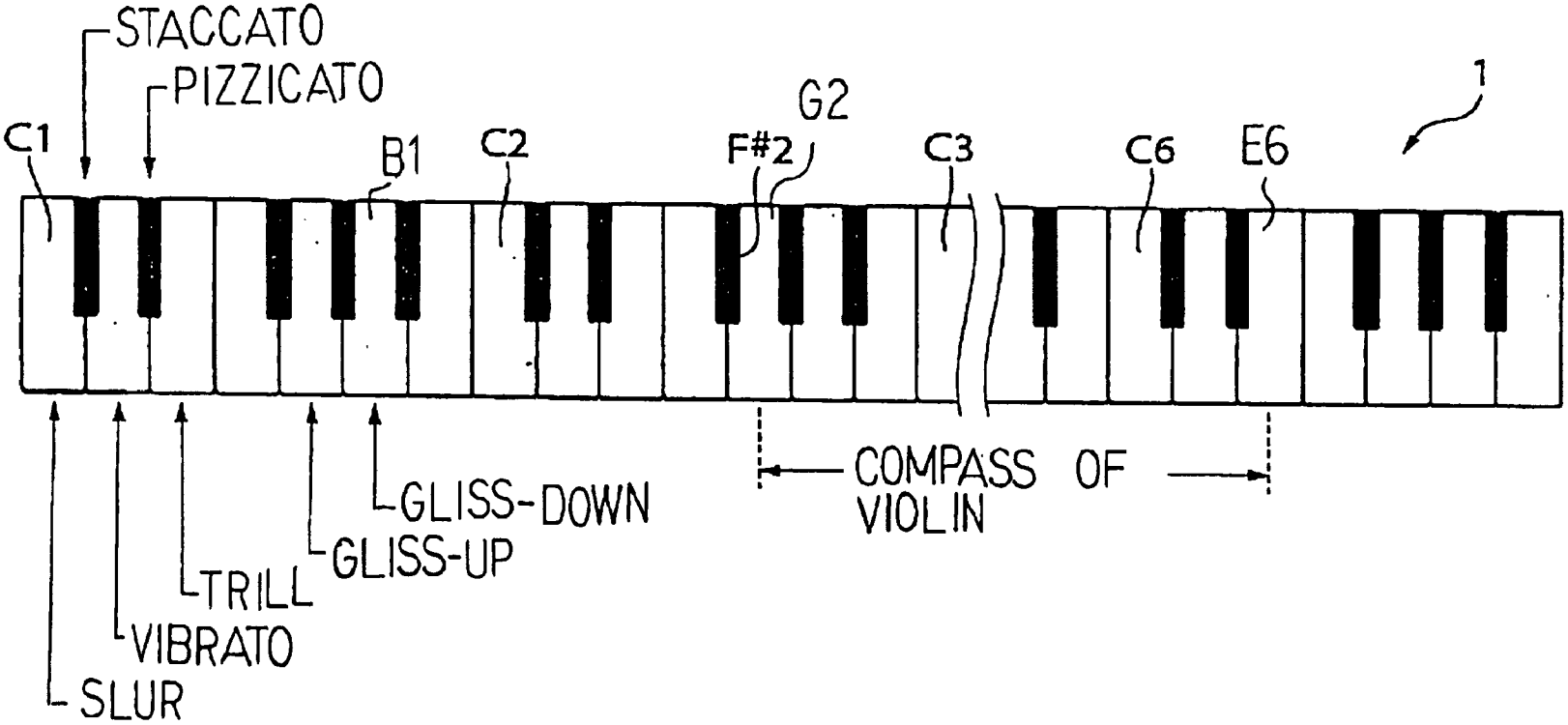
FIG. 7 is a schematic view showing the compass of a violin on the keyboard of the silent piano.

For example, the violin has the compass narrower than the compass of the upright piano 100, and the compass practically ranges from G2 to E6 as shown in FIG. 7. This means that there are many idle key levers 1*a* on both sides of the compass from G2 to E6. The white and black keys C1 to B1 are, by way of example, assigned to the slur, staccato, vibrato, pizzicato, trill, gliss-up and gliss-down. These musical performance styles may be frequently employed in performance on the violin. Of course, other musical performance styles may be further assigned to the idle key levers 1*a*. In this instance, the leftmost idle key levers 1*a* are assigned to the musical performance styles. However, the musical performance styles may be assigned the idle key levers 1*a* close to the compass of the violin.

A player is assumed to select the timbre of violin. While the player is fingering on the black/white key levers 1*a* between G2 and E6, the tone generating unit 11 accesses one of the blocks 26 assigned to the set of pieces of waveform data representative of the electronic tones to be produced in violin timbre, and produces the audio signal from the read-out pieces of violin waveform data. The electronic tones are converted through the sound system 201 from the series of read-out pieces of violin waveform data. The series of pieces of violin waveform data read out from the block are representative of the electronic tones to be produced as if performed on an acoustic violin in the default musical performance style in so far as the player does not specify another musical performance style through the idle key levers 1*a*. The default musical performance style may be the standard musical performance style, i.e., the player simply bows the strings of a corresponding acoustic violin. Of course, the player can designate another musical performance style as the default musical performance style.

The player is assumed to depress one of the idle key levers 1*a* such as, for example, C1. The key sensor 3 assigned the white key lever C1 changes the key position signal representative of the current key position, and supplies the key position signal to the central processing unit 5. The central processing unit 5 fetches the piece of positional data representative of the current key position in the data storage area of the volatile memory 7, and determines that the player depresses the idle key lever C1 on the basis of the accumulated positional data for the white key lever C1. Then, the central processing unit 5 raises the flag, to which a data storage area in the key number table has been already assigned, and produces the music data code representative of the musical performance style, i.e., slur. The central processing unit 5 supplies the music data code representative of the slur to the temporary data storage in the volatile memory 7, and stores it at the predetermined address.

Thereafter, the player depresses the black/white key lever or key levers 1*a* in the compass. The associated key sensor 3 reports the change of the current key position to the central processing unit 5, and the central processing unit 5 acknowledges the request for the tone generation at the pitch or pitches. Then, the central processing unit 5 produces the music data code representative of the note-on at the pitch and a velocity, and supplies the music data code to the tone generating unit 11 together with the music data code representative of the slur. When the music data codes reach the tone generating unit 11, the tone generating unit 11 changes the record to be accessed from the default musical performance style to the slur, and reads out the series of pieces of violin waveform data for the electronic tone to be produced as if performed on the acoustic violin in slur.

The player is assumed to release the white key lever C1. The key sensor 3 changes the key position signal, and supplies it to the central processing unit 5. The central processing unit 5 acknowledges the release of the white key lever C1, and takes down the flag representative of the slur.

The central processing unit 5 supplies the music data code representative of the default musical performance style to the temporary data storage, and replaces the music data code representative of the slur to the music data code representative of the default musical performance style.

The player continues the fingering on the black and white key levers 1*a* in the compass, and the central processing unit 5 produces and supplies the music data codes representative of the note-on/note-off at the pitches to the tone generating unit 11 together with the music data code representative of the musical performance style. The music data code representative of the slur is never incorporated in the music data codes. The music data code for the musical performance style represents the default musical performance style. For this reason, the electronic tones are produced as if performed on the acoustic violin in the default musical performance style.

Figure 8:
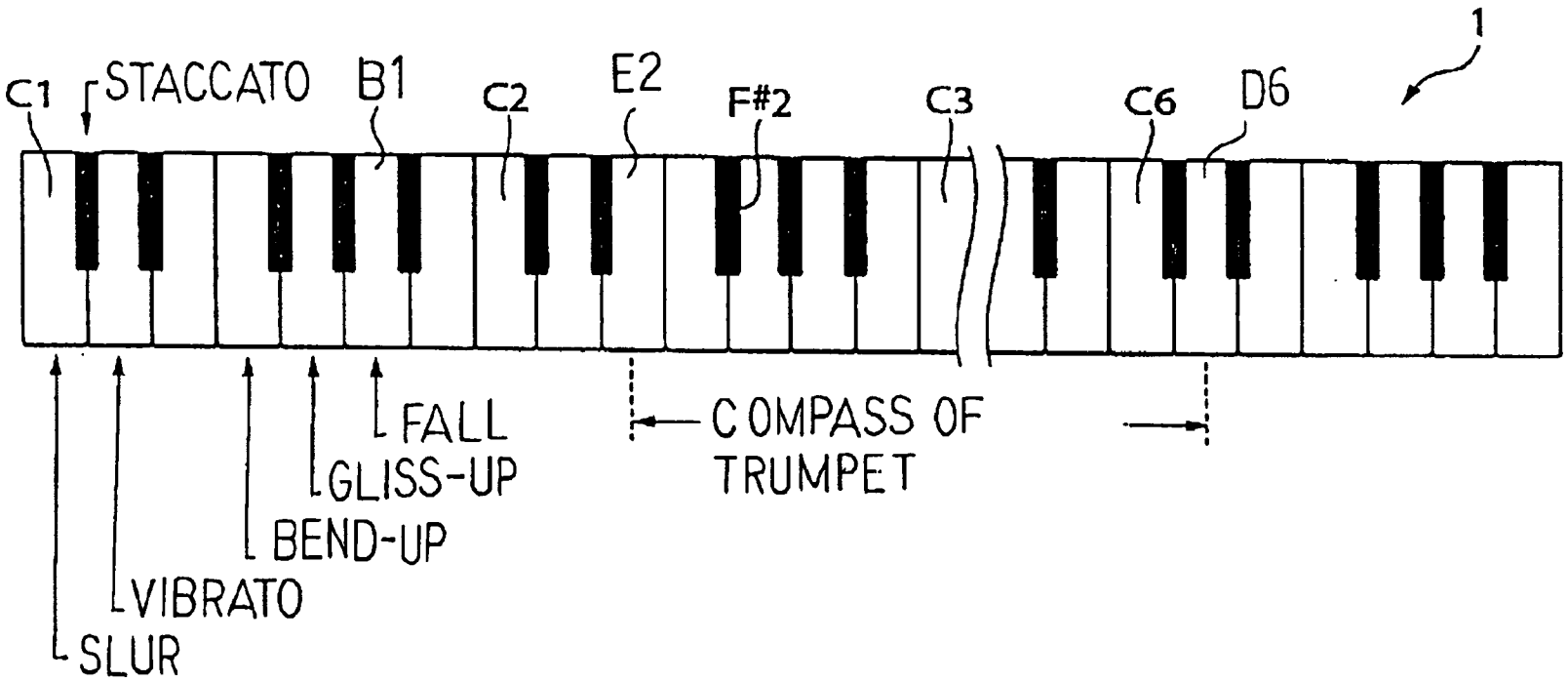
FIG. 8 is a schematic view showing the compass of a trumpet on the keyboard of the silent piano.

The trumpet has the compass wider than the compass of the violin. However, the compass of the violin is still narrower than the compass of the upright piano 100. The compass of the trumpet is varied depending upon the skill of the player. For the ordinary skilled player, the compass ranges from E2 to Bb4. However, the compass is widened by proficient players. The compact for the proficient players ranges from E2 to D6 as shown in FIG. 8. Even though, the compass is still narrower than the compass of the upright piano 100. The leftmost black and white key levers 1*a* are also available for the musical performance styles. In this instance, the slur, staccato, vibrato, bendup, gliss-up and fall are assigned to the idle key levers 1*a*.

When a player depresses and releases the idle key lever in his or her performance, the key sensors 3, central processing unit 5 and tone generating unit 11 behaves as similar to those already described with reference to FIG. 7. Flags are selectively raised and taken down depending upon the key state of the idle key levers 1*a*, and the electronic tone are produced as if performed on the trumpet in the default or designated musical performance style.

Computer Programs

Main Routine Program

Figure 9:
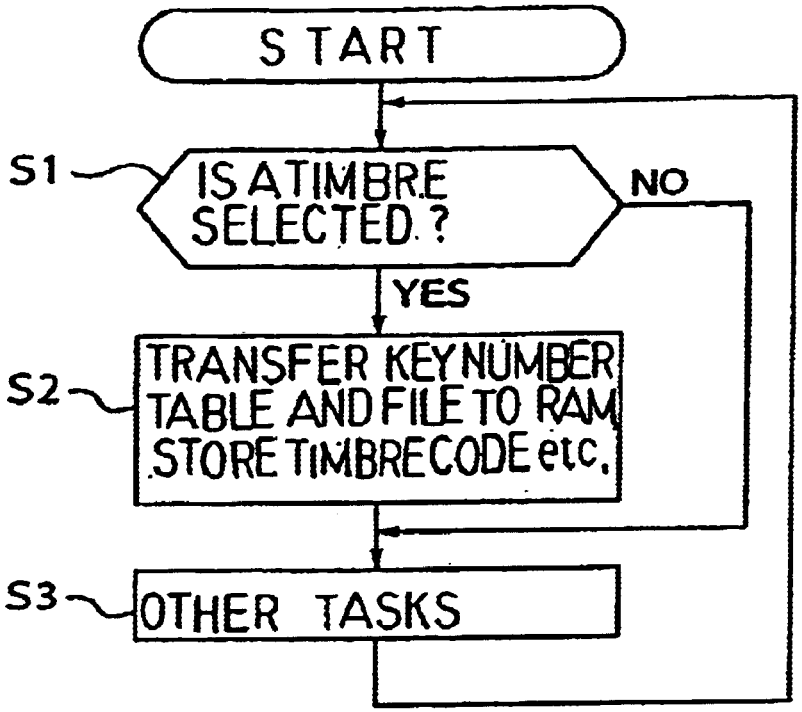
FIG. 9 is a flowchart showing a main routine program on which a central processing unit runs.

FIG. 9 shows the main routine program on which the central processing unit 5 runs. The electronic sound generating system 200 is assumed to be powered. The central processing unit 5 firstly initializes the system. The application programs are transferred from the external memory unit 8 to the volatile memory 7, if any. Moreover, the key number table for the default timbre is created in a data area of the volatile memory 7, and the timbre code representative of the default timbre is stored in the register of the tone generating unit 11. A music data code representative of the default musical performance style is initially stored in the data area.

Upon completion of the system initialization, the central processing unit 5 enters the loop consisting of steps S1, S2 and S3, and repeats those steps S1, S2 and S3 until the user removes the electric power from the electronic sound generating system 200.

In the loop, the central processing unit 5 checks the data port assigned to the switch sensors 4 to see whether or not the user depresses any one of the switches assigned the timbres for selecting one of the timbres as by step S1. If the answer at step S1 is given negative, the central processing unit 5 proceeds to step S3, and achieves other tasks.

One of the tasks is to control the loudness of the electronic tones. The user gives the instruction for the loudness by manipulating the volume switches so that the central processing unit 5 checks the data port assigned the switch sensors 4 associated with the volume switches to see whether or not the user manipulates the volume switches. When the user instructs the central processing unit 5 to increase or decrease the loudness of the electronic tones, the central processing unit 5 requests the sound system 201 to increase or decrease the loudness. Another task is to request the display unit 9 to selectively produce visual images representative of prompt messages, acknowledgement and current status.

On the other hand, when the user selects a timbre such as, for example, a guitar, the answer at step S1 is given affirmative, and the central processing unit 5 proceeds to step 2. The tasks to be achieved at step 2 are as follows. The central processing unit 5 transfers the key number table corresponding to the selected timbre from the non-volatile memory 6 to the data area of the volatile memory 7, and the key number table for the default timbre is replaced with the key number table for the selected timbre. The central processing unit 5 further transfers the timbre code representative of the selected timbre to the tone generating unit 11, and the default timbre code is replaced with the new timbre code. Moreover, the central processing unit 5 transfers the file TCDk such as the file TCD5 from the external memory 8 to the volatile memory 7, and makes the volatile memory 7 hold the file TCDk in the waveform memory 7*a*. Thus, the new key number table, new timbre code and selected file TCDk are stored in the data area of the volatile memory 7, register of the tone generating unit 11 and the waveform memory 7*a*, respectively.

Upon completion of the data transfer from the non-volatile memory 6 and external memory 8 to the volatile memory 7, tone generating unit 5 and waveform memory 7*a*, the central processing unit 5 requests the display unit 9 to produce the visual image representative of the prompt message such as, for example, "Do you wish to reassign the idle key levers 1*a* to the musical performance styles?". If the user does not wish the reassignment, the relation between the idle key levers 1*a* and the musical performance styles is confirmed in the key number table, and the central processing unit 5 proceeds to step S3.

On the other hand, when the user wishes to reassign the idle key levers 1*a* to the possible musical performance styles, which may be the mute, glissando, tremolo, hammering-on and pulling-off under the selection of the guitar timbre, the user instructs the central processing unit 5 to reassign the idle key levers 1*a* to the musical performance styles through the manipulating panel 2. Then, the central processing unit 5 requests the display unit 9 to produce the visual images representative of one of the possible musical performance styles and prompt message such as, for example, "Please depress a key lever out of the compass of the selected acoustic musical instrument. Otherwise, you instruct me to skip the present musical performance style." The user is assumed to depress an idle key lever 1*a* in response to the prompt message. Then, the central processing unit 5 specifies the depressed idle key lever 1*a*, and assigns the corresponding flag to the musical performance style, and requests the display unit 9 to produce the visual images representative of the prompt message for the next musical performance style. On the other hand, if the user instructs the central processing unit 5 to skip the present musical performance style through the manipulating panel 2, the central processing unit 5 confirms the flag already assigned to the present musical performance style, and requests the display unit 9 to produce the prompt message for the next musical performance style. Upon completion of the reassignment, the central processing unit 5 proceeds to step S3.

Subroutine Program

Figure 10:
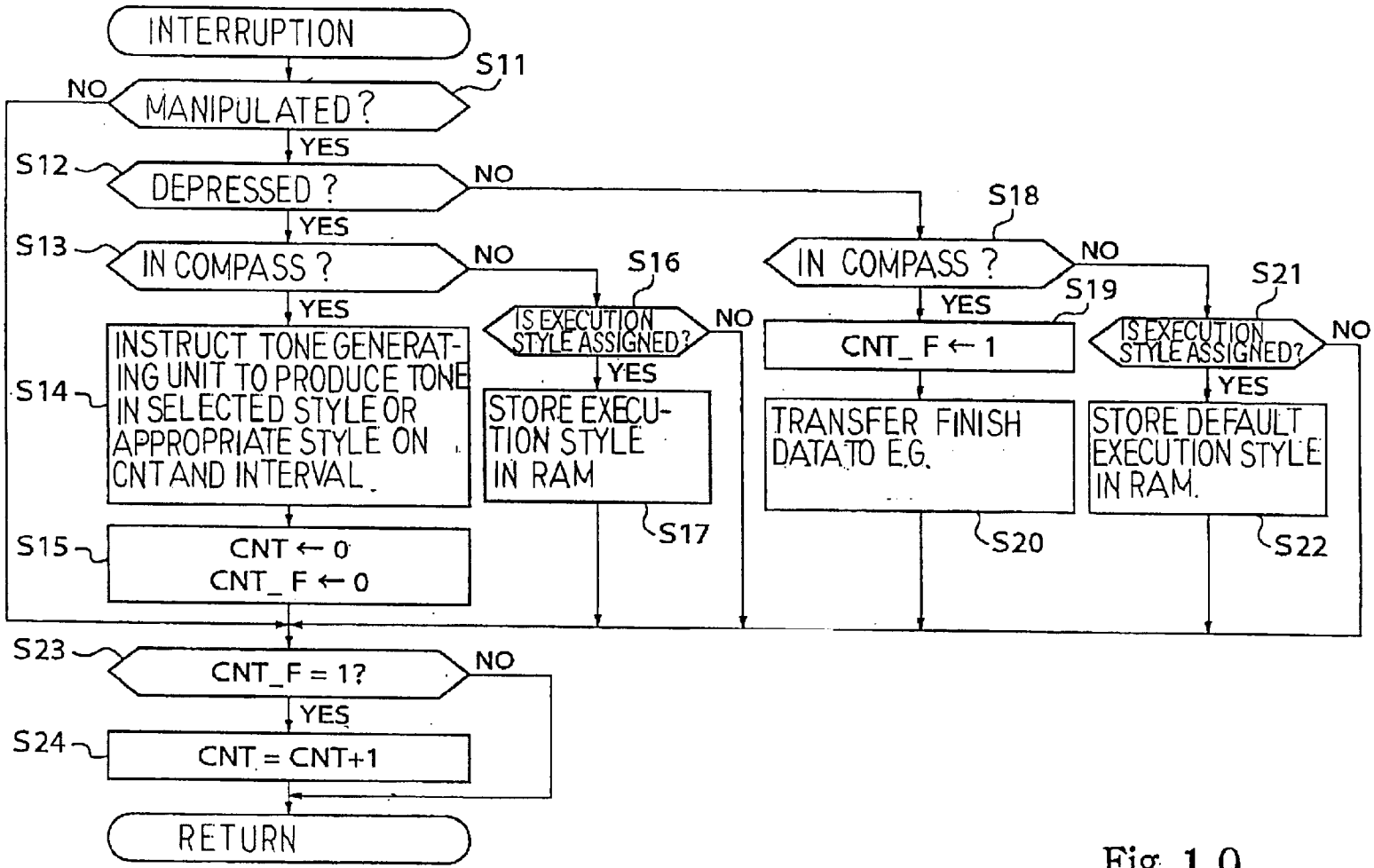
FIG. 10 is a flowchart showing a subroutine program for producing electronic tones.

While the central processing unit 5 is reiterating the loop consisting of steps S1 to S3, a software timer gives rise to an interruption at predetermined time intervals. When the software timer notifies the central processing unit 5 of the expiry of the predetermined time period, the main routine program branches to the sub-routine program shown in FIG. 10.

The jobs to be executed in the subroutine program are different depending upon the change of the current key status, i.e., A) an idle key lever 1*a* assigned to a certain musical performance style is depressed, B) the idle key lever 1*a* assigned to the certain musical performance style is released, C) a black or white key lever 1*a* in the compass is depressed, D) the black or white key lever 1*a* in the compass is released and E) the black or white key lever 1*a* has been already released.

Description is hereinafter made on the subroutine program on the assumption that the current status is changed from A through C, D, B, C and D to E. A player is assumed to assign the idle key levers 1*a* to the slur, staccato, vibrator, pizzicato, trill, gliss-up and gliss-down for the violin timbre as shown in FIG. 7.

While the player is fingering a piece of music on the keyboard 1, he or she is assumed to depress the white key lever C1. The software timer notifies the central processing unit 5 of the timer interruption. Then, the main routine program branches to the subroutine program, and the central processing unit 5 checks the key number table to see whether or not the player changes the current key state of any one of the black and white key levers 1*a* as by step S11. The white key lever C1 has been already depressed. Then, the answer at step S11 is given affirmative. The central processing unit 5 further checks the key number table to see whether or not the white key C1 has been depressed or released as by step S12. The answer at step S12 is given affirmative. The central processing unit 5 proceeds to step S13, and checks the key number table to see whether or not the depressed white key lever C1 is in the compass of the violin. The white key lever C1 is out of the compass of the violin so that the answer at step S13 is given negative.

Subsequently, the central processing unit 5 further checks the key number table to see whether or not any musical performance style has been assigned the white key lever C1 as by step S16. If the answer is given negative, the central processing unit 5 returns to the main routine program after the completion of the jobs at step S23 and S24, which will be described in conjunction with E. However, the white key lever C1 has been assigned to the slur (see FIG. 7). This means that the positive answer is given to the central processing unit 5 at step S16. Then, the central processing unit 5 proceeds to step S17, and does the following jobs. The central processing unit 5 produces the music data code representative of the selected musical performance style, i.e., slur, and writes the music data code representative of the slur in the predetermined data area. In other words, the music data code representative of the default musical performance style is replaced with the music data code representative of the slur. Thus, the musical performance style is held in the volatile memory 7. Upon completion of the jobs at step S17, the central processing unit 5 does the jobs at steps S23 and S24, and returns to the main routine program.

The player is assumed to depress the white key lever 1*a* assigned to G2, which is in the compass of the violin. When the software timer notifies the central processing unit 11 of the timer interruption immediately thereafter, the main routine program branches to the subroutine program, again. The flag for the white key G2 has been raised, and is indicative of the depressed state. The central processing unit 5 checks the key number table to see whether or not the player manipulates any one of the black and white key levers 1*a* at step S1, thereafter, whether or not the manipulated key lever 1*a* is changed to the depressed state at step 12 and, furthermore, whether or not the depressed key lever 1*a* is incorporated in the compass. All the answers at steps S11, S12 and S13 are given affirmative. Then, the central processing unit 5 proceeds to step S14.

The central processing unit 5 accesses the predetermined data area assigned to the music data code representative of the musical performance style, i.e., slur, software counter, another data area assigned to the velocity and yet another data area assigned to the interval in pitch between the previous electronic tone and the electronic tone to be produced, and produces the music data codes for the electronic tone to be produced. The central processing unit 5 supplies the music data codes to the tone generating unit 11. Thus, the central processing unit 5 instructs the tone generating unit 11 to produce the electronic tone in slur at step S14.

Upon reception of the music data codes, the tone generating unit 11 specifies the record to be accessed, and sequentially reads out the series of pieces of violin waveform data from the record. The audio signal is produced from the series of pieces of violin waveform data, and is converted to the electronic tone at the pitch G2 as if performed in the slur.

After step S14, the central processing unit 11 takes down the control flag CNT-F, and zero is reset into the software counter CNT at step S15. The central processing unit 5 does the jobs at steps S23 and S24, and returns to the main routine program. The player releases the white key lever G2 after a certain time period, and the timer interruption occurs after the release of the white key lever G2. The flag for the white key lever G2 has been taken down. Accordingly, the central processing unit 5 finds the answer at step S11 and the answer at step S12 to be affirmative and negative. Then, the central processing unit 5 proceeds to step S18 to see whether or not the released key lever 1*a* is in the compass of the violin. The answer at step S18 is given affirmative, and the central processing unit 5 requests the tone generating unit 11 to transfer the piece of finish data, which is appropriate to the designated musical performance style, to the envelop generator EG so that the sound system 201 decays the electronic tone at the pitch G2. The central processing unit 5 does the jobs at steps S23 and S24, and returns to the main routine program.

The player is assumed to release the white key lever C1, and the timer interruption occurs immediately after the release of the white key C1. The flag for the white key lever C1 has been taken down, and accordingly, the central processing unit 5 finds the answer at step S11, answer at step S12 and answer at step S18 to be positive, negative and negative. With the negative answer at step S18, the central processing unit 5 proceeds to step S21 to see whether or not any one of the musical performance style has been already assigned the released key lever 1*a*. The slur has been assigned to the white key C1 so that the answer at step S21 is given affirmative. Then, the central processing unit 5 transfers the music data code representative of the default musical performance style to the predetermined data area in the volatile memory 7, and the music data code representative of the slur is replaced with the music data code representative of the default musical performance style. The central processing unit 5 does the jobs at step S23 and S24, and returns to the main routine program.

Thereafter, the player is assumed to depress the white key lever C3, which is in the compass of the violin. The main routine program branches to the subroutine program at the timer interruption. The flag for the white key lever C3 has been raised, and, accordingly, the central processing unit 5 finds the answers at steps S11, S12 and S13 to be affirmative. With the positive answer at step S13, the central processing unit 5 produces the music data codes representative of the generation of the electronic tone at pitch C3 at the calculated velocity in the default musical performance style, and supplies the music data codes to the tone generating unit 11 at step S14. The tone generating unit 11 accesses the record assigned to the set of pieces of normal waveform data, and sequentially reads out the series of pieces of violin waveform data corresponding to the electronic tone at C3. The series of pieces of violin waveform data are formed into the audio signal, and the audio signal is converted to the electronic tone at C3 as if performed in the default musical performance style.

Subsequently, the central processing unit 5 takes down the control flag CNT-F, and zero is reset into the software counter CNT as by step S15. The software counter CNT is incremented at each timer interruption in so far as the control flag CNT-F has been raised. However, the control flag CNT-F has been taken down. Then, the answer at step S23 is given negative, and the central processing unit 5 immediately returns to the main routine program.

While the player is keeping the white key lever C3 depressed, the answer at step S11 is always given negative, and the answer at step S23 is also given negative. For this reason, the central processing unit 5 immediately returns to the main routine program, and the electronic tone is continuously produced at the pitch C3.

When the player releases the white key lever C3, the flag for the white key lever C3 is taken down, and the central processing unit 5 finds the answer at step S11, answer at step S12 and answer at step S18 to be positive, negative and positive in the subroutine program after the entry at the timer interruption. The central processing unit 5 raises the control flag CNT-F at step S19, and requests the tone generating unit 11 to transfer the piece of finish data for the default musical performance style to the envelop generator EG. The envelope generator EG starts to decay the envelope of the audio signal, and the electronic tone is gradually decayed at step S20.

The central processing unit 5 proceeds to step S23 to see whether or not the control flag CNT-F has been raised. Since the control flag CNT-F was raised at step S19, the answer at step S23 is given affirmative. With the positive answer at step S23, the central processing unit 5 proceeds to step S24 so that the software counter CNT increments the stored value by one. Upon completion of the job at step S24, the central processing unit 5 returns to the main routine program.

Whenever the timer interruption occurs without change of the key state, the central processing unit 5 finds the answer at step S11 and answer at step S23 to be negative and affirmative, and causes the software counter CNT to increment the stored value. Thus, the value stored in the software counter CNT is indicative of the lapse of time from the latest key release.

The player is assumed to depress another black/white key 1*a* in the compass of the violin. After entry into the subroutine program, the central processing unit 5 finds the answers at steps S11, S12 and S13 to be affirmative, and proceeds to step S14. As described hereinbefore, the default musical performance style has been registered into the predetermined data area of the volatile memory 7. However, the central processing unit 5 does not always request the tone generating unit 11 to produce the electronic tone in the default musical performance style at step S14. For example, in case where the software counter CNT keeps zero, it is appropriate to produce the next electronic tone in slur. For this reason, the central processing unit 5 supplies the music data code representative of the slur to the tone generating unit 11 together with other music data codes.

The central processing unit 5 reiterates the loops consisting of steps S11 to S24 at every timer interruption until the electronic power is removed from the electronic sound generating system 200, and requests the tone generating unit 11 to produce the electronic tones in the possible musical performance styles.

As will be appreciated from the foregoing description, there are many idle key levers outside of the compass of a selected musical instrument, and musical performance styles are selectively assigned to the idle key levers. The number of the idle key levers outside of the compass is greater than the number of the foreign key levers, which are usually not used in the performance on a piece of music in a certain keynote. This means that a large number of musical performance styles are available for pieces of music. Thus, the musical instrument according to the present invention makes the user perform pieces of music in adequate expression.

Moreover, the idle key levers are provided on either side or both sides of the compass unique to the acoustic musical instrument. This feature is preferable to the foreign key levers in the certain keynote, because the player easily discriminates the idle key levers rather than the foreign key levers, which are mixed with the key levers for designating the pitches.

Modifications

Although particular embodiments of the present invention have been shown and described, it will be apparent to those skilled in the art that various changes and modifications may be made without departing from the spirit and scope of the present invention.

In the above-described embodiment, the software counter CNT measures the time period from the decay of the previous electronic tone to the generation of the next electronic tone, and the central processing unit 5 discriminates the slur on the basis of the time period. Another software timer may measure the time period over which the electronic tone is generated, and the central processing unit 5 discriminates a certain musical performance style on the basis of the other software timer or both of the software timers.

The musical performance styles described in conjunction with the acoustic musical instruments do not set any limit to the technical scope of the present invention. Various musical performance styles are known to the skilled persons. Other records may be provided for those musical performance styles.

In the above-described embodiment, the musical performance styles are assigned the idle key levers in the leftmost region. However, the musical performance styles may be assigned the idle key levers adjacent to the black/white key levers in the compass.

Nevertheless, it may be preferable to space the idle key levers assigned the musical performance styles from the black and white key levers 1*a* in the compass from the view point that the player does not mistakenly depress the idle keys. In order to make the user easily discriminate the idle key levers assigned the musical performance styles, only the black idle key levers or only the white idle key levers may be assigned the musical performance styles.

In the above-described embodiment, all the idle key levers assigned the musical performance styles are located on the left side of the compass. This is because of the fact that the player frequently depress the black/white keys 1*a* for designating the pitches with the right fingers. However, the musical performance styles may be assigned to the idle key levers on the right side of the compass or on both sides of the compass depending upon the piece of music to be performed.

The upright piano does not set any limit on the technical scope of the present invention. The acoustic piano 100 may be of the grand type. The present invention may appertain to an electronic piano or another sort of the electronic keyboard musical instrument. An automatic player system may be further incorporated in the acoustic piano 100 together with the silent system 300.

Moreover, the keyboard musical instrument does not set any limit to the technical scope of the present invention. The present invention may appertain to a percussion instrument such as, for example, an electronic vibraphone. A musical instrument to which the present invention appertains may belong to an electronic stringed instrument or an electronic wind instrument. An example of the electronic stringed instrument may have switches at the frets. When the player presses the string or strings to the fret or frets, the switch or switches turn on, and the electronic sound generating system produces the tones depending upon the switches closed with the strings. Thus, the switches are used in the designation of the tones. However, some frets may be not used in the performance on a piece of music with a certain keynote. The switches associated with the idle frets are available for the present invention. The idle frets may be used for changing the timbre of the electronic tones. Thus, the present invention is applicable to any sort of musical instrument.

Personal computer systems, in which suitable software has been already loaded, are available for the playback of a piece of music. Therefore, the personal computer systems and other electronic systems capable of reproducing a piece of music are fallen within the term "musical instrument". In case of the personal computer system, a user may finger a piece of music on a virtual keyboard produced on a screen of the display unit or designate the pitch names and musical performance styles through a cursor moved by means of a mouse. Of course, a computer keyboard is available for the performance.

The computer programs, i.e., the main routine program, subroutine program and other computer programs may be stored in another sort of information storage medium such as, for example, optomagnetic disc, CD-ROM disc, CD-R disc, CD-RW disc, DVD-ROM, DVD-RAM, DVD-RW, DVD+RW, magnetic tape or non-volatile memory card. The computer programs may be supplied from a server computer through a communication network such as, for example, an internet to the musical instrument, which includes the personal computer systems or the like. The method for producing the electronic tones in various musical performance styles are realized in the computer programs. Certain jobs may be done through a certain capability of an operating system. The computer programs may be stored in a memory on an expanded capable board or unit, and a central processing unit or microprocessor on the board or unit runs on the computer programs.

The MIDI standards do not set any limit to the technical scope of the present invention. The music data codes may be formatted in accordance with any protocol for music.

The change-over mechanism 61 may exert the torque on the hammer stopper 60 through an electric motor.

The compasses of the acoustic musical instruments do not set any limit to the technical scope of the present invention. The idle key levers may be found in the compass. A piece of music may be performed in one or two octaves within the compass of an acoustic musical instrument. In this instance, the other key levers out of the octave or octaves stand idle in the performance on the keyboard musical instrument, and are available for the designation of the musical performance styles. In case where a set of the music data codes representative of the piece of music have been already stored in the external memory unit 8, the central processing unit 5 may analyze the music data codes to see whether or not all the keys to be depressed are fallen within the compass. If the central processing unit 5 finds an octave to be out of the piece of music, the central processing unit 5 informs the player of the idle key lever or levers through the display unit 9, and prompts the user to use the idle key levers for the designation of the musical performance styles.

Claim languages are correlated with the parts of the silent piano as follows. The keyboard 1 is corresponding to a manipulator array, and the black and white keys 1*a* serve as plural manipulators. However, in case of a personal computer system, the computer keyboard or a virtual keyboard produced on the display unit serves as the manipulator array. In case of a stringed instrument, the frets serve as the plural manipulators.

The central processing unit 5, non-volatile memory 6, key sensors 3 and switch sensors 4 as a whole constitute a data processor. The data port assigned to the switch sensors 4 serves as a reception port.

What is claimed is:

1. A musical instrument capable of producing tones in different musical performance styles, comprising:

a manipulator array including plural manipulators respectively assigned pitch names and independently used in performance; and an electronic sound generating system connected to said manipulator array, assigning at least one musical performance style different from a default musical performance style to at least one manipulator selected from said manipulator array and located outside of a group of other manipulators continuously arranged in said manipulator array, and responding to manipulation on said other manipulators without any manipulation on said at least one manipulator for producing tones at the pitch names identical with the pitch names assigned to said other manipulated manipulators in said default musical performance style and further to the manipulation on said other manipulators after the manipulation on said at least one manipulator for producing said tones in said at least one musical performance style.

2. The musical instrument as set forth in claim 1, in which said group of other manipulators includes a manipulator assigned the highest pitch name of a compass of an acoustic musical instrument, another manipulator assigned the lowest pitch name of said compass and manipulators respectively assigned the pitch names between said highest pitch name and said lowest pitch name.

3. The musical instrument as set forth in claim 2, in which said electronic sound generating system is responsive to an instruction indicative of a timbre of said acoustic musical instrument so as to determine said compass.

4. The musical instrument as set forth in claim 3, in which said timbre is selected from plural timbres, which have been already prepared.

5. The musical instrument as set forth in claim 3, in which said electronic sound generating system includes a waveform memory having at least one data file assigned to said timbre and containing plural data records storing plural series of pieces of waveform data representative of waveforms of said tones to be produced in said default musical performance style and other plural series of pieces of waveform data representative of waveforms of said tones to be produced in said at least one musical performance style, a data processor monitoring said manipulator array and responsive to said manipulation on said other manipulators and said at least one manipulator so as to produce pieces of music data representative of the pitch names of said tones to be produced and another piece of music data representative of said at least one musical performance style or said default musical performance style, a tone generating unit connected to said data processor and said waveform memory and responsive to said another piece of music data for selecting one of said plural data records assigned to said at least one musical performance style or said default musical performance style and to said pieces of music data for selectively reading out said plural series of waveform data or said other plural series of pieces of waveform data, thereby producing an audio signal representative of said tones to be produced.

6. The musical instrument as set forth in claim 1, in which said electronic sound generating system includes a waveform memory having at least one data file containing plural data records storing plural series of pieces of waveform data representative of waveforms of said tones to be produced in said default musical performance style and other plural series of pieces of waveform data representative of waveforms of said tones to be produced in said at least one musical performance style, a data processor monitoring said manipulator array and responsive to said manipulation on said other manipulators and said at least one manipulator so as to produce pieces of music data representative of the pitch names of said tones to be produced and another piece of music data representative of said at least one musical performance style or said default musical performance style, a tone generating unit connected to said data processor and said waveform memory and responsive to said another piece of music data for selecting one of said plural data records assigned to said at least one musical performance style or said default musical performance style, said tone generating unit further responsive to said pieces of music data in the presence of said another piece of music data representative of said at least one musical performance style so as to selectively read out said other plural series of pieces of waveform data, thereby producing an audio signal representative of said tones to be produced in said at least one musical performance style.

said tone generating unit further responsive to said pieces of music data in the presence of said another piece of music data representative of said default musical performance style so as to selectively read out said plural series of pieces of waveform data, thereby producing an audio signal representative of said tones to be produced in said default musical performance style.

7. The musical instrument as set forth in claim 6, in which said data processor is responsive to an instruction indicative of a timbre of said tones so as to select said at least one data file from a plurality of data files already prepared for other timbres, and in which said group of other manipulators includes a manipulator assigned the highest pitch name of a compass of an acoustic musical instrument having said timbre, another manipulator assigned the lowest pitch name of said compass and manipulators respectively assigned the pitch names between said highest pitch name and said lowest pitch name.

8. The musical instrument as set forth in claim 1, in which said manipulator array is a keyboard having plural key levers.

9. The musical instrument as set forth in claim 8, in which said plural key levers are selectively colored in black and white, and the black key levers and the white key levers are laid on the pattern of a piano keyboard.

10. The musical instrument as set forth in claim 9, in which at least one of the black and white key levers serves as said at least one manipulator, and is located outside of a group of the black and white key levers assigned the pitch names consistent with pitch names in a compass of an acoustic musical instrument different from an acoustic piano.

11. The musical instrument as set forth in claim 10, in which said at least one of the black and white key levers is located on the left side of said group of the black and white key levers.

12. The musical instrument as set forth in claim 11, in which said at least one of the black and white key levers is leftward spaced from said group of the black and white key levers by the other black and white key levers.

13. The musical instrument as set forth in claim 9, further comprising plural action units respectively connected to said black key levers and said white key levers and selectively actuated when the associated black key levers and the associated white key levers are depressed, plural hammers respectively associated with said plural action units and selectively driven for rotation by the actuated action units, plural strings respectively associated with said plural hammers and selectively struck with the associated hammers at the end of said rotation for producing acoustic piano tones at the pitch names identical with the pitch names assigned the depressed black key levers and the depressed white key levers, and a silent system including a hammer stopper changed between a free position where said plural hammers are allowed to strike said plural strings and a blocking position where said plural hammers rebound thereon before striking said plural strings.

14. A method for producing tones, comprising the steps of:

a) assigning at least one musical performance style different from a default musical performance style to at least one manipulator, which is located outside of a group of other manipulators continuously arranged in a manipulator array for designating pitch names of tones to be produced, in response to a user's instruction;

b) periodically checking said manipulator array to see whether or not said user manipulates said at least one manipulator and whether or not said user selectively manipulates said other manipulators;

c) producing tones at pitch names identical with the pitch names assigned to the manipulated manipulators in said default musical performance style if said user has not manipulated said at least one manipulator;

d) producing tones at pitch names identical with the pitch names assigned to the manipulated manipulators in said at least one musical performance style without execution at said step c) if said user has manipulated said at least one manipulator; and e) repeating said steps b), c) and d) for producing said tones selectively in said default musical performance style and said at least one musical performance style.

15. The method as set forth in claim 14, in which said step a) includes the sub-steps of a-1) checking a reception port to see whether or not the user instructs to change a default timbre to another timbre, a-2) identifying a range of pitch names assigned to said group of the other manipulators with a compass of an acoustic musical instrument capable of producing acoustic tones in said another timbre when said answer at step a-1) is given affirmative so that said at least one musical performance style is assigned to said at least one manipulator outside of said group of said other manipulators.

16. The method as set forth in claim 15, in which said at least one manipulator is automatically specified outside of said group of the other manipulators.

17. The method as set forth in claim 15, in which said sub-step a-2) includes the sub-steps of a-2-1) identifying said range of pitch names assigned to said group of the other manipulators with said compass, and a-2-2) prompting said user to select said at least one manipulator from manipulators outside of said group of the other manipulators for said at least one musical performance style.

18. A computer program for a method of producing tones, comprising the steps of:

a) assigning at least one musical performance style different from a default musical performance style to at least one manipulator, which is located outside of a group of other manipulators continuously arranged in a manipulator array for designating pitch names of tones to be produced, in response to a user's instruction;

b) periodically checking said manipulator array to see whether or not said user manipulates said at least one manipulator and whether or not said user selectively manipulates said other manipulators;

c) producing tones at pitch names identical with the pitch names assigned to the manipulated manipulators in said default musical performance style if said user has not manipulated said at least one manipulator;

d) producing tones at pitch names identical with the pitch names assigned to the manipulated manipulators in said at least one musical performance style without execution at said step c) if said user has manipulated said at least one manipulator; and e) repeating said steps b), c) and d) for producing said tones selectively in said default musical performance style and said at least one musical performance style.

19. The computer program as set forth in claim 18, in which said step a) includes the sub-steps of a-1) checking a reception port to see whether or not the user instructs to change a default timbre to another timbre, a-2) identifying a range of pitch names assigned to said group of the other manipulators with a compass of an acoustic musical instrument capable of producing acoustic tones in said another timbre when said answer at step a-1) is given affirmative so that said at least one musical performance style is assigned to said at least one manipulator outside of said group of said other manipulators.

20. The computer program as set forth in claim 19, in which said at least one manipulator is automatically specified outside of said group of the other manipulators.

21. The computer program as set forth in claim 19, in which said sub-step a2) includes the sub-steps of a-2-1) identifying said range of pitch names assigned to said group of the other manipulators with said compass, and a-2-2) prompting said user to select said at least one manipulator from manipulators outside of said group of the other manipulators for said at least one musical performance style.

* * * * *